US011306384B2

(12) United States Patent
Scott et al.

(10) Patent No.: US 11,306,384 B2
(45) Date of Patent: Apr. 19, 2022

(54) STRENGTHENING MECHANISM FOR THERMALLY SPRAYED DEPOSITS

(71) Applicant: ResOps, LLC, Tomball, TX (US)

(72) Inventors: Joe L. Scott, Tomball, TX (US); Tien Thanh Le, Tomball, TX (US)

(73) Assignee: Resops, LLC, Tomball, TX (US)

( * ) Notice: Subject to any disclaimer, the term of this patent is extended or adjusted under 35 U.S.C. 154(b) by 781 days.

(21) Appl. No.: 16/010,294

(22) Filed: Jun. 15, 2018

(65) Prior Publication Data

US 2019/0010598 A1 Jan. 10, 2019

Related U.S. Application Data

(60) Provisional application No. 62/530,521, filed on Jul. 10, 2017.

(51) Int. Cl.

| | |
|---|---|
| ***C23C 4/06*** | (2016.01) |
| ***C23C 4/131*** | (2016.01) |
| ***C23C 4/18*** | (2006.01) |
| ***C23C 4/16*** | (2016.01) |
| ***C23C 28/02*** | (2006.01) |

(Continued)

(52) U.S. Cl.

CPC ..... *C23C 4/06* (2013.01); *B05C 3/04* (2013.01); *C23C 4/123* (2016.01); *C23C 4/129* (2016.01); *C23C 4/131* (2016.01); *C23C 4/134* (2016.01); *C23C 4/16* (2013.01); *C23C 4/18* (2013.01); *C23C 28/021* (2013.01); *E21B 17/02* (2013.01)

(58) Field of Classification Search

CPC .... C23C 4/00; C23C 4/04; C23C 4/06; C23C 4/123; C23C 4/129; C23C 4/131; C23C 4/134; C23C 4/137

See application file for complete search history.

(56) References Cited

U.S. PATENT DOCUMENTS 3,596,344 A * 8/1971 Kreider ..... C23C 4/18 427/370

4,276,353 A 6/1981 Novinski et al.

(Continued)

FOREIGN PATENT DOCUMENTS

EP 0210644 A1 4/1987

EP 0254324 A1 1/1988

*Primary Examiner* — Walter Aughenbaugh

(74) *Attorney, Agent, or Firm* — Park, Vaughan, Fleming & Dowler LLP; Shane Nelson

(57) ABSTRACT

The present disclosure provides a method, system, and apparatus that adds one or more reinforcing structures to a thermally sprayed layer of metallic material onto a substrate to reinforce and/or further support the formed substrate coating. The reinforcing structure may be a metallic or non-metallic wire, filament, whisker, mesh, or similar structure and may be coupled to the substrate before or during the thermal spray process, thereby embedding the reinforcing structure(s) into the resulting thermal spray matrix. The type, material, size, shape, and application technique of the reinforcing structure is variable based upon the desired characteristics of the ultimate coating. The durable coating may be formed by a plurality of separate and/or distinct layers. The resultant coating (e.g., the reinforcing structure(s) with the one or more thermal spray layers) provides numerous benefits, including increased strength and resistance to spalling, breaking, cracking, deforming, crack formation, and corrosion.

33 Claims, 14 Drawing Sheets

(51) Int. Cl.

| | |
|---|---|
| ***C23C 4/123*** | (2016.01) |
| ***B05C 3/04*** | (2006.01) |
| ***C23C 4/129*** | (2016.01) |
| ***C23C 4/134*** | (2016.01) |
| *E21B 17/02* | (2006.01) |

(56) References Cited

U.S. PATENT DOCUMENTS

| | | | | |
|---|---|---|---|---|
| 4,305,449 | A | 12/1981 | Loszewski et al. | |
| 4,923,665 | A * | 5/1990 | Andersen | B28B 7/342 106/38.2 |
| 4,978,557 | A | 12/1990 | Drake et al. | |
| 5,211,776 | A | 5/1993 | Weiman | |
| 5,217,815 | A | 6/1993 | Das et al. | |
| 5,439,750 | A | 8/1995 | Ravenhall et al. | |
| 5,511,604 | A | 4/1996 | Ravenhall et al. | |
| 5,897,922 | A | 4/1999 | Saxena et al. | |
| 6,468,594 | B1 | 10/2002 | Fages | |
| 7,419,704 | B2 | 9/2008 | Passman et al. | |
| 7,487,840 | B2 * | 2/2009 | Gammage | C22C 38/02 166/380 |
| 8,574,667 | B2 | 11/2013 | John et al. | |
| 8,871,306 | B2 | 10/2014 | Niccolls et al. | |
| 9,920,412 | B2 | 3/2018 | Scott et al. | |
| 2005/0025896 | A1 | 2/2005 | Grinberg et al. | |
| 2005/0153821 | A1 | 7/2005 | Grinberg | |
| 2010/0092751 | A1 | 4/2010 | Englhart et al. | |
| 2010/0154936 | A1 | 6/2010 | Urevich | |
| 2012/0060961 | A1 * | 3/2012 | Kral | B32B 15/043 138/153 |
| 2014/0141257 | A1 | 5/2014 | Ranade et al. | |
| 2014/0158295 | A1 | 6/2014 | Badrak | |

* cited by examiner 1105 1109 1107

STRENGTHENING MECHANISM FOR THERMALLY SPRAYED DEPOSITS

PRIORITY

This application claims priority to U.S. provisional patent application Ser. No. 62/530,521, filed on Jul. 10, 2017, the entire content of which is incorporated herein by reference.

BACKGROUND OF THE INVENTION

Field of the Invention

The invention relates to coatings applied to tools, equipment, and other substrates, and more particularly to thermally sprayed layers that includes a reinforcing structure as a strengthening mechanism, such as a wire, filament, whisker, or mesh.

Description of the Related Art

Drilling wells for oil and gas recovery, as well as for other purposes, involve the use of drill pipes which, at one end, are equipped with a drilling bit whose function is to cut through various types of rock formations. The most severe abrasive wear conditions occur when drilling through highly siliceous geological earth formations. A rotational movement of the pipe ensures the progression of drilling. Pipes commonly used today come in sections of about 30 feet in length. These sections are connected to one another by means of tool joints. Typically these tool joints, which themselves are protected against wear by abrasion resistant welded overlays, have a diameter significantly larger than the body of the pipes. Under conditions of vertical drilling the tool joints protect the body of the pipes quite efficiently.

More recent technology has evolved that utilizes directional drilling, meaning the deviation of drilling from vertical to horizontal over more or less large bending radiuses of curvature. Coupled with the use of increased pipe section lengths of about 45 feet and larger diameters relative to the tool joint diameter, tool joints offer a lesser degree of protection of the body of the pipe and direct interaction of the pipe body with the walls of the well is more likely to occur. One consequence is an exposure of the pipe to wear mechanisms that may affect its integrity to a significant degree. When drilling into mineral formations, the wear mechanism involved is mainly abrasion. When drilling takes place into a steel casing or marine riser (where a marine riser connects a floating drilling or production unit to the wellhead(s) on the sea floor and through which the drill pipe passes), the wear mechanism is predominantly metal-to-metal wear with interposition of drilling fluids and drill cuttings. These wear situations are also encountered with other downhole equipment such as coiled tubing, downhole tools housing expensive instrumentation and other components exposed to longitudinal and rotational wear during well drilling operations.

As is known in the art, the term "thermal spray" is a generic term for a group of processes in which metallic, ceramic, cermet, and some polymeric materials in the form of powder, wire, or rod are fed to a torch or gun with which they are heated to near or somewhat above their melting point. The resulting molten or nearly molten droplets of materials are projected against the surface to be coated. Upon impact, the droplets flow into thin lamellar particles adhering to the surface, overlapping and interlocking as they solidify. The total coating thickness is usually generated in multiple passes of the coating device; depending on the application, the layer may be applied in thick deposits exceeding 0.100", although ranges in the amount between 0.020" up to 3.0" are possible. Various thermal spray techniques may include flame spraying, flame spray and fuse, electric-arc (wire-arc) spray, and plasma spray. Thermal spray may be applied to a wide variety of tools, equipment, structures, and materials, and is not limited to merely downhole components. Thermal spray with special alloys is applied to drill pipe, casing, sucker rods and other components used in the drilling, completion and production of oil and natural gas. Among other benefits, this application is used to mitigate wear, reduce friction, and to create a standoff from the annulus of the hole.

The prior art discloses various methods for thermal spraying. For example, U.S. Pat. No. 7,487,840 ("the '840 patent"), incorporated herein by reference, discloses a protective wear coating on a downhole component for a well through a thermal spraying process in combination with an iron-based alloy. The thermal spraying process melts the material to be deposited while a pressurized air stream sprays the molten material onto the downhole component. The coating operation takes place at low temperatures without fusion or thermal deterioration to the base material. The wear resistance is increased while providing a lower coefficient of friction by the wear resistant layer relative to a coefficient of friction of the downhole equipment without the wear resistant layer. FIG. 3 of the '840 patent is reproduced in the present disclosure as FIG. 1A as an exemplary thermal spraying process that may be used in conjunction with the present invention. The following two paragraphs describe FIG. 3 of the '840 patent are reproduced from the specification of the '840 patent at column 6, 11. 3-27:

"FIG. 3 is a schematic diagram of an exemplary thermal spray system for applying a wear resistant layer to a downhole component, according to the present invention. One type of thermal spraying system 30 that is advantageously used is a twin wire system. The twin wire system uses a first wire 32 and a second wire 34. In at least one embodiment, the first wire 32 and the second wire 34 generally are of the same nature, whether solid or tubular, and the same diameter, but not necessarily of the same chemical composition. For example, the first wire 32 could be of a first composition, while the second wire 34 could of the same or a complementary composition to the first composition to yield a desired wear resistant layer on the base material."

"A voltage is applied to the wires. The proximity of the wire ends creates an arc 35 between the ends and cause the wires to melt. A high-pressure compressed air source 36 atomizes molten metal 38 caused by the arcing into fine droplets 40 and propels them at high velocity toward the downhole component, such as conduit 10 or other components, to being deposited on the external surface 26. The twin wire spraying process can use commercially available equipment, such as torches, wire feeding systems and power sources. Other thermal spraying processes are available and the above is only exemplary as the present invention contemplates thermal spraying processes in general for this particular invention."

While conventional thermally sprayed layers (such as that disclosed in the '840 patent) may be useful in some instances, in certain applications (such as on drill pipe and tools that are subject to severe flexing, torque and impact) they fail because the sprayed metal is brittle and develops cracks that propagate in fatigue loading. In particular, a significant part of the coating applied to drill pipes using conventional thermally sprayed layers may be "spalled" off and/or otherwise broken into smaller pieces, as shown for example in FIG. 1B. Such spalling significantly reduces the benefits of the coated layer and in many instances makes the drill pipe unusable for the intended application. Thus, conventionally thermally sprayed layers have not been dependable for drill pipe and are subjected to breaking, cracking, deforming, etc. under various applications.

A need exists for an improved method and system for thermally sprayed layers that are more resistant to cracking, breaking, and/or failure. A need exists for an improved method and system for thermally sprayed layers on downhole components that is more impact resistant, wear resistant, and/or corrosion resistant, and/or is otherwise more durable than existing thermally sprayed layers. A need exists for providing a strengthening mechanism and/or a reinforcing structure to layers of thermally sprayed material.

SUMMARY OF THE INVENTION

The present disclosure provides a method, system, and apparatus that adds one or more reinforcing structures to a thermally sprayed layer of metallic material onto a substrate to reinforce and/or further support the formed substrate coating. The reinforcing structure may be a metallic or non-metallic wire, filament, whisker, mesh, or similar structure and may be coupled to the substrate before or during the thermal spray process, thereby embedding the reinforcing structure(s) into the resulting thermal spray matrix. The type, material, size, shape, and application technique of the reinforcing structure is variable based upon the desired characteristics of the ultimate coating. The durable coating may be formed by a plurality of separate and/or distinct layers. The resultant coating (e.g., the reinforcing structure(s) with the one or more thermal spray layers) provides numerous benefits, including increased strength and resistance to spalling, breaking, cracking, deforming, crack formation, and corrosion.

Embodiments of the disclosure may provide a method for forming a coating on a substrate. The method may comprise providing a substrate having an external surface, thermally spraying a layer of metallic material on the external surface, and embedding one or more reinforcing structures into the thermal spray layer. The method may further comprise bonding the thermal spray layer with the one or more reinforcing structures. The method may further comprise depositing the metallic material onto the substrate such that the material solidifies and forms into a layer of material on the substrate and around the one or more reinforcing structures. The method may further comprise forming a coating on the external surface that comprises the metallic material and the one or more reinforcing structures. In one embodiment, the thermal spray technique may comprise twin wire arc spray. The substrate may be a downhole component that is substantially cylindrical or substantially flat shaped.

The method may further comprise coupling the one or more reinforcing structures to the external surface during the thermally spraying step. The method may further comprise coupling the one or more reinforcing structures to the external surface prior to the thermally spraying step. The method may further comprise spraying the one or more reinforcing structures onto the external surface by compressed gas at the same time or prior to the thermally spraying step. The method may further comprise wrapping the one or more reinforcing structures around at least a portion of the substrate prior to the thermally spraying step. In one embodiment, the method may further comprise thermally spraying a second layer of metallic material onto the first layer of metallic material and embedding one or more reinforcing structures into the second layer of thermal spray.

The one or more reinforcing structures may take a wide variety of different shapes, configurations, and compositions. In one embodiment, the one or more reinforcing structures comprises a continuous wire. In another embodiment, the one or more reinforcing structures comprises a plurality of whiskers. In another embodiment, the one or more reinforcing structures comprises mesh. The one or more reinforcing structures may be a different composition and/or material than the metallic material utilized within the thermal spray layer.

In another embodiment, an embodiment of the disclosure may provide a method for forming a coating on a substrate, which may comprise providing a substrate having an external surface, coupling one or more reinforcing structures to the external surface, and thermally spraying a layer of metallic material onto the one or more reinforcing structures. In one embodiment, the method may comprise embedding the one or more reinforcing structures into the thermal spray layer. The method may further comprise depositing the metallic material onto the substrate such that the material solidifies and forms into a layer of material on the substrate and around the one or more reinforcing structures.

In one embodiment, the coupling step comprises wrapping a wire around the external surface. In one embodiment, the coupling step comprises spraying a plurality of whiskers onto the external surface by compressed gas. In one embodiment, the coupling step comprises attaching a mesh to the external surface at the same time or prior to the thermally spraying step. In one embodiment, the coupling step comprises attaching the one or more reinforcing structures to the external surface of the substrate using micro-welding.

Embodiments of the disclosure may provide a thermally sprayed coating on a substrate. In one embodiment, the coating may comprise a layer of thermally sprayed metallic material on a substrate and one or more reinforcing structures embedded within the layer of the thermally sprayed metallic material. In one embodiment, the one or more reinforcing structures is non-metallic. In another embodiment, the one or more reinforcing structures is metallic. In one embodiment, the one or more reinforcing structures comprises one or more continuous wires. For example, the one or more reinforcing structures may comprise wire with a diameter of at least approximately 0.006". The one or more reinforcing structures co may comprise a plurality of whiskers. The one or more reinforcing structures may comprise a mesh of metallic or non-metallic wires.

In one embodiment, the coating may comprise greater wear resistance than a coating without the one or more reinforcing structures. The coating may comprise a corrosion resistant layer. The coating may comprise an impact resistant layer. The coating may comprise a wear resistant layer. In one embodiment, the coating may be formed by a twin wire thermal spraying process. In one embodiment, the coating comprises a plurality of different thermally sprayed layers, wherein the coating comprises a first layer with a first composition and a second layer with a second composition. In one embodiment, the coating comprises a thickness of at least 0.10 inches on the substrate, while in another embodiment the coating comprises a thickness of less than 0.10 inches on the substrate. The substrate may take any number of shapes or configurations, and in one embodiment may be a downhole component, such as drill pipe.

Embodiments of the disclosure may provide a modified downhole component with a more durable coating. In one embodiment, the downhole component may comprise a downhole component with an external surface, one or more reinforcing structures coupled to an external surface of the downhole component, and a layer of metallic material that is thermal sprayed onto a portion of the external surface. In one embodiment, one or more reinforcing structures is embedded within the thermally sprayed layer. In one embodiment, the thermally sprayed layer is adapted by the thermal spraying to maintain bonding with the base material of the downhole component and/or the one or more reinforcing structures, such as when used downhole. In one embodiment, the component is a drill pipe, while in other embodiments the component may be a drill pipe tool joint or other downhole tool.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1A:
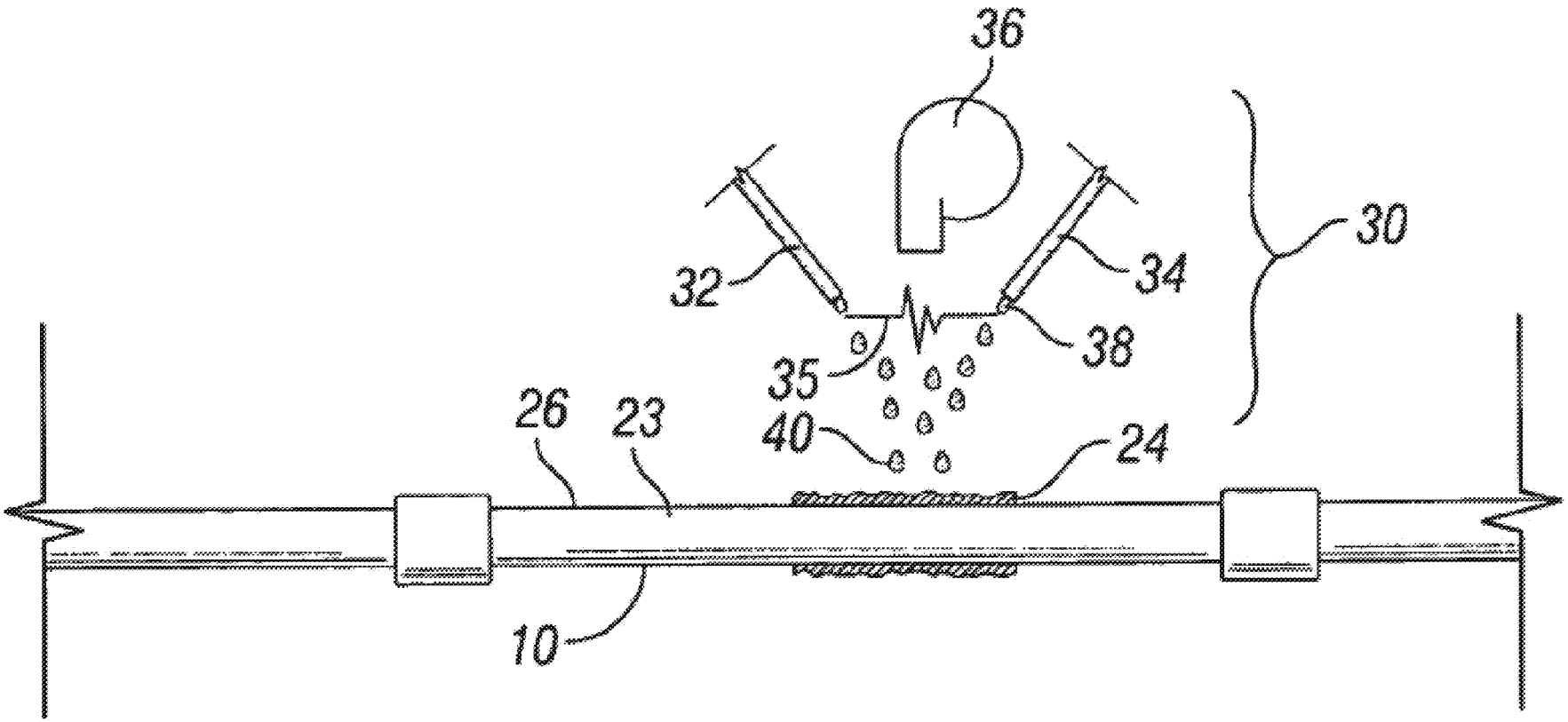
FIG. 1A (PRIOR ART)
FIG. 1A illustrates one prior art method of thermally spraying a downhole component, which is taken from FIG. 3 of U.S. Pat. No. 7,487,840.

Various features and advantageous details are explained more fully with reference to the nonlimiting embodiments that are illustrated in the accompanying drawings and detailed in the following description. Descriptions of well known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. The following detailed description does not limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

The present disclosure adds a reinforcing structure, such as a wire, filament, whisker, or mesh structure, to conventionally sprayed thermal layers to reinforce and/or further support the applied thermally sprayed layer. The reinforcing structure(s) may be a different composition and/or material than the material of the thermal spray layer. The reinforcing structure acts as a strengthening mechanism to increase the durability of the coating. The reinforcing structure may be added to the surface of the structure to be coated with thermal spray before or during the thermal spray process. Such an application thereby embeds the reinforcing structure into the resulting thermal spray matrix. In one embodiment, "embedding" a reinforcing structure as used herein means to place, fix, bury, enclose, integrate, and/or otherwise incorporate the reinforcing structure into the surrounding thermally sprayed material. The reinforcing structure(s) may be applied to a structure separate from the thermal spray process (such as a separate winding machine) or may be applied in conjunction with the thermal spray process itself (such as by integrating wire shavings/whiskers, etc. into an air stream that is applied to the structure) or may be physically applied by an operator or automated machine (such as a mesh screen). The reinforcing structure may be applied in a wide variety of shapes, sizes, and patterns, as well as different application techniques. For example, a wire may be applied circumferentially, diagonally, or in a cross-hatched diamond pattern, and multiple wires may be used simultaneously. Multiple layers and/or types of reinforcing structures may be used, as well as multiple layers of thermally sprayed layers. The resulting coating is a combination of the one or more layer(s) of thermally sprayed material with the one or more reinforcing structures embedded within the layer(s) of the thermally sprayed material. The resultant coating (e.g., the one or more reinforcing structures and the one or more layers of thermal spray) can be applied to a wide range of substrates. The resulting coating provides a higher cohesive strength and may be more impact resistant, wear resistant, and corrosion resistant, and/or otherwise more durable than conventional thermally sprayed coatings without such reinforcing structures. Further, the resulting coating provides numerous other benefits, such as (but not limited to) increased resistance to breaking, cracking, and deforming, the ability to provide increased thicknesses of thermal spray, increased flexibility of the thermal spray layer, increased protection from spalling in an impacted area, increased resistance to crack propagation and corrosion, decreased crack formation, and added strength. The disclosed technology is applicable to both corrosion resistant overlays as well as wear resistant applications.

Figure 2A:
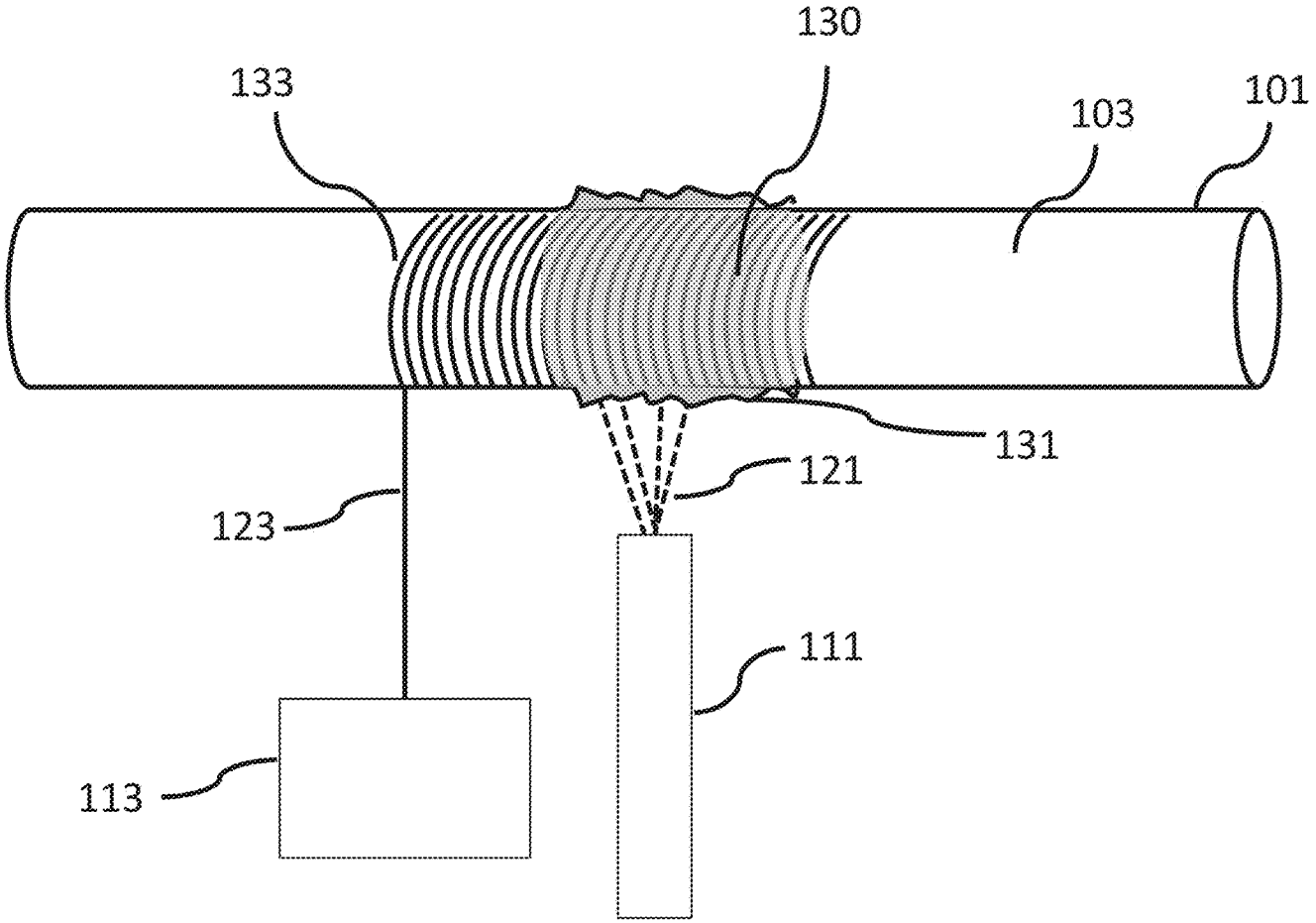
FIG. 2A illustrates a schematic diagram of a thermal spray system applying a coating to a downhole component with the use of wire as the reinforcing structure according to one embodiment of the present disclosure.

FIG. 2A illustrates a schematic diagram of a thermal spray system applying a durable thermal spray coating to a downhole component with the use of a wire as the reinforcing structure. In one embodiment, the durable coating may be an impact, wear, and/or corrosion resistant layer. While FIG. 2A illustrates the use of a reinforcing wire, one or more metallic or non-metallic filaments or mesh structures may be attached, coupled, and/or fixed to a surface to be coated with thermal spray.

As shown in FIG. 2A, reinforcing wire 123 may be applied to an external surface 103 of the tool to be coated, such as downhole tool/conduit 101. The tool 101 may be cylindrical, but other non-cylindrical shapes may similarly be covered with a reinforcing wire and thermally sprayed consistent with the present disclosure. The reinforcing wire 123 may be applied by a cable spool 113. In one embodiment, a first portion of wire 123 is attached to tool 101 (such as by securing a first end of the wire with tape or micro-welds besides the intended application area) and while tool 101 is rotated it automatically pulls reinforcing wire 123 from wire spool 113. Multiple spools may be used to simultaneously apply a plurality of wires. In other embodiments, one or more spools are rotated around the non-rotating pipe thereby applying reinforcing wire to the drill pipe (or other object to be coated) without requiring the drill pipe to rotate. In one embodiment, such rotating spools may be attached to a device that is secured to the object to be coated (e.g., drill pipe). In one embodiment, the wire is wrapped around the tool such that a reinforcing wire layer 133 is applied circumferentially around the tool. The wire may be securely attached to the tool or merely coupled to the tool. In one embodiment, the wire is generally tightly wrapped around the tool such that substantially all of the wire is touching the external surface 103 of the tool.

In one embodiment, reinforcing wire 123 is wrapped circumferentially around the tool. In other embodiments, the wire may be diagonally wrapped or applied in at various angles. In still another embodiment, the wire may be applied to the tool in a mesh, such as a grid, interwoven, and/or interlocking pattern (such as a cross-hatched diamond pattern). The wire may be applied to the tool in a single wire thickness around the tool, or in some embodiments multiple layers of wires may be applied to build up the reinforcing layer and/or coating. In still other embodiments, a first reinforcing wire may be applied in a first direction and a second reinforcing wire may be applied in a second direction. If multiple wires are used, the wires may be the same size and material or different sizes and materials. The wire may be wrapped with various spacing around the tool. For example, each wire wrap around the tool may be touching the adjacent wire wraps for a close spacing of the wire with no to limited open spaces between adjacent wires. In other embodiments, the wire spacing between adjacent wires may be more than the diameter of the wire, while in some embodiments the spacing may be less than the diameter of the wire. For example, in one embodiment, the reinforcing wire should be wrapped around the tool such that there is at least a 1/16-inch gap between each adjacent wire, which allows a portion of the thermal spray material to contact and/or bond with the exterior surface of the tool. In other embodiments, the gap between the adjacent reinforcing wire may be as large as 1/8 or 1/4 inches.

For the purposes of this disclosure, a reinforcing wire as envisioned herein applies to continuous or non-continuous strands of metallic or non-metallic wire, which may include one or more twisted or woven filaments. The reinforcing wire can take many different shapes, sizes, materials, and can have differential compositions and characteristics. For example, the reinforcing wire may be round, flat, rectangular, oval, triangular, serrated, and other configurations, and may contain surface contours such as fins, ribs, serrations or other geometric shapes. In other words, a wire is not necessarily round or symmetrical. Similarly, the reinforcing wire may be tubular or solid, as well as cored or woven. The material, shape, and diameter of the wire (which is not necessarily round) is variable based upon various desired characteristics, such as the thickness of the thermal spray layer and the desired strength and/or resistance to impact or corrosion of the layer and/or coating, and the desired thickness of the overall coating applied to the tool. The wire may be relatively small, such as between 0.006" to 0.010" in diameter. In one embodiment, the diameter of the wire may range between 0.0008" up to 0.62", while other sizes may be possible based on the intended application. The reinforcing wire may be of (or at least partially comprise) any varieties of alloys or metals, such as steel, alloyed, stainless steel, nickel, copper, cobalt, graphene, carbon, etc. The reinforcing wire may be coated, such as with a second metallic layer (different than the base material of the wire) or a heat resistant coating. The wire (as well as other reinforcing structures) may be coated with a dissimilar metal or compound to enhance adhesion chemically with the substrate and/or thermal spray layer, such as carbon, boon, beryllium, lithium, or a fluxing agent such as silico-fluoride or potassium fluoride. In other embodiments, the reinforcing wire itself may be a heat resistant non-metallic wire or filament. In general, the alloy, material, shape, and size of the wire are all variables of the reinforcing wire based upon the particular characteristics of the thermal spray, tool, application of the tool, and desired properties of the coating. Further, multiple reinforcing wires may be used simultaneously. For example, the first and second reinforcing wires may generally be of the same nature and diameter but not necessarily of the same chemical composition. The first wire could be of a first composition, while the second wire could be of the same or a complementary composition to the first wire composition to yield a desired coating on the base material (such as a desired impact, wear, and/or corrosion resistant layer). The first and second reinforcing wires may be applied at substantially the same time or the first wire applied followed by application of the second wire.

As mentioned herein, the present disclosure includes a reinforcing structure (such as a wire, filament, whisker, mesh, etc.) with a conventional thermal spraying system, such as that described in U.S. Pat. No. 7,487,840, incorporated herein by reference. One type of thermal spraying system 111 that is advantageously used is a twin wire system. As is known in the art and as described in more detail in relation to prior art FIG. 1A and U.S. Pat. No. 7,487,840, incorporated herein by reference, a voltage is applied to the twin wires and the proximity of the wire ends creates an arc between the wire ends and cause the wires to melt. A high-pressure compressed air source atomizes molten metal caused by the arcing into fine droplets and propels them at high velocity toward the downhole component, such as conduit or other components, to being deposited on a surface of the substrate, whether it is an external or internal surface. The twin wire spraying process can use commercially available equipment, such as torches, wire feeding systems and power sources. As is known in the art, the two wires used for the twin wire spraying process may generally be of the same nature and diameter but not necessarily of the same chemical composition; in other words, the two wires may be of different size, shape, and material depending on the desired characteristics of the thermal spray. Of course, other thermal spraying processes may be used with this disclosure, such as flame spraying, flame spray and fuse, electric-arc (wire-arc) spray, plasma spray, twin wire arc spray, cold spray, kinetic metallization, and high velocity oxygen fuel (HVOF), and the above is only exemplary as the present disclosure contemplates a wide variety of thermal spraying processes in general for the disclosed invention.

As shown in FIG. 2A, metallic fine droplets 121 are deposited onto the external surface 103 of tool 101 by thermal spraying system 111. One or more thermal spray layer(s) 131 is formed on the external surface of the tool by the metallic droplets 121 and is coupled to both the reinforcing wire 133 and the external surface 103. A resulting coating 130 is provided on the external tool surface that comprises both the reinforcing wire and the thermal spray layer. Among many other benefits, this coating is more resistant to impact and wear and provides a friction reduction layer to the tool and is considered more durable than prior art thermally sprayed layers. In general, a "wear resistant layer" and/or durable coating as discussed herein is a coating of material dissimilar to the pipe or tool material being coated that may range between 0.020" and 3.0" of thickness that substantially lowers wear on the tool and produces less friction than the conventional base material (e.g., bare steel). The coating may also provide beneficial stand-off of the component from the annulus. The disclosed thermal spray layer with reinforcing wire likewise provides increased resistance to wear and enhanced friction reduction properties. In one embodiment, the thermal spray substantially bonds with both the layers of reinforcing wire 133 and the external surface 103 of the object to be sprayed. In other embodiments, the thermal spray substantially bonds with just reinforcing wire 133, while in still other embodiments the thermal spray substantially bonds with just the external surface 103. In one embodiment, coating 130 does not cause significant metallurgical effects on the base material of the component and does not raise the temperature of the base material sufficiently to cause thermal damage to typical internal coatings, for example, on instrumentation and other downhole components. As mentioned above, the resulting coating provides numerous benefits compared to prior art thermally sprayed layers and the characteristics of the coating may be variable based on the reinforcing structure(s) utilized. For example, a coating of the present disclosure may provide not only a far superior wear surface compared to other types of applied coatings, such as-paint, epoxy coating, and powder coatings, but also provides a significantly increased impact resistant layer of thermal spray as well as corrosion resistant thermally sprayed overlays.

Coating 130 is generally repairable, and the downhole component can be repeatedly recoated with the thermal coating process disclosed herein. For example, a first reinforcing layer and first thermally sprayed layer may be applied to the surface, and a second reinforcing layer and a second thermally sprayed layer may be applied over the first layers. The coating resists spalling or otherwise peeling off and provides a surface that is much more resistant to impact and/or damage than prior applications of thermal spraying.

The wires used for the reinforcing wire may be the same or different than the wires (or metal powder) used in the thermal spray process. For example, the reinforcing wire may use a wire with a particular diameter and material, while the thermal spray process may use two wires that are each a different composition than the reinforcing wire. Thus, the composition and material of the reinforcing structure can be different than the material sprayed onto the substrate via the thermal spraying process.

In one embodiment, the reinforcing structure is introduced onto the pipe or tool 101 simultaneously with applying the thermal spray. For example, as shown in FIG. 2A, reinforcing wire 113 may be wrapped onto the tool 101 while the thermal spray is being coated on a separate section of the tool that has been just wrapped. In this way, the tool can be rotated for simultaneous application of the thermal spray and the reinforcing wire. In other embodiments, the tool may be wrapped or reinforced previously with a wire, filament, or mesh. The thermal spray process can then be performed separate from the wire-wrapping process.

Figure 2B:
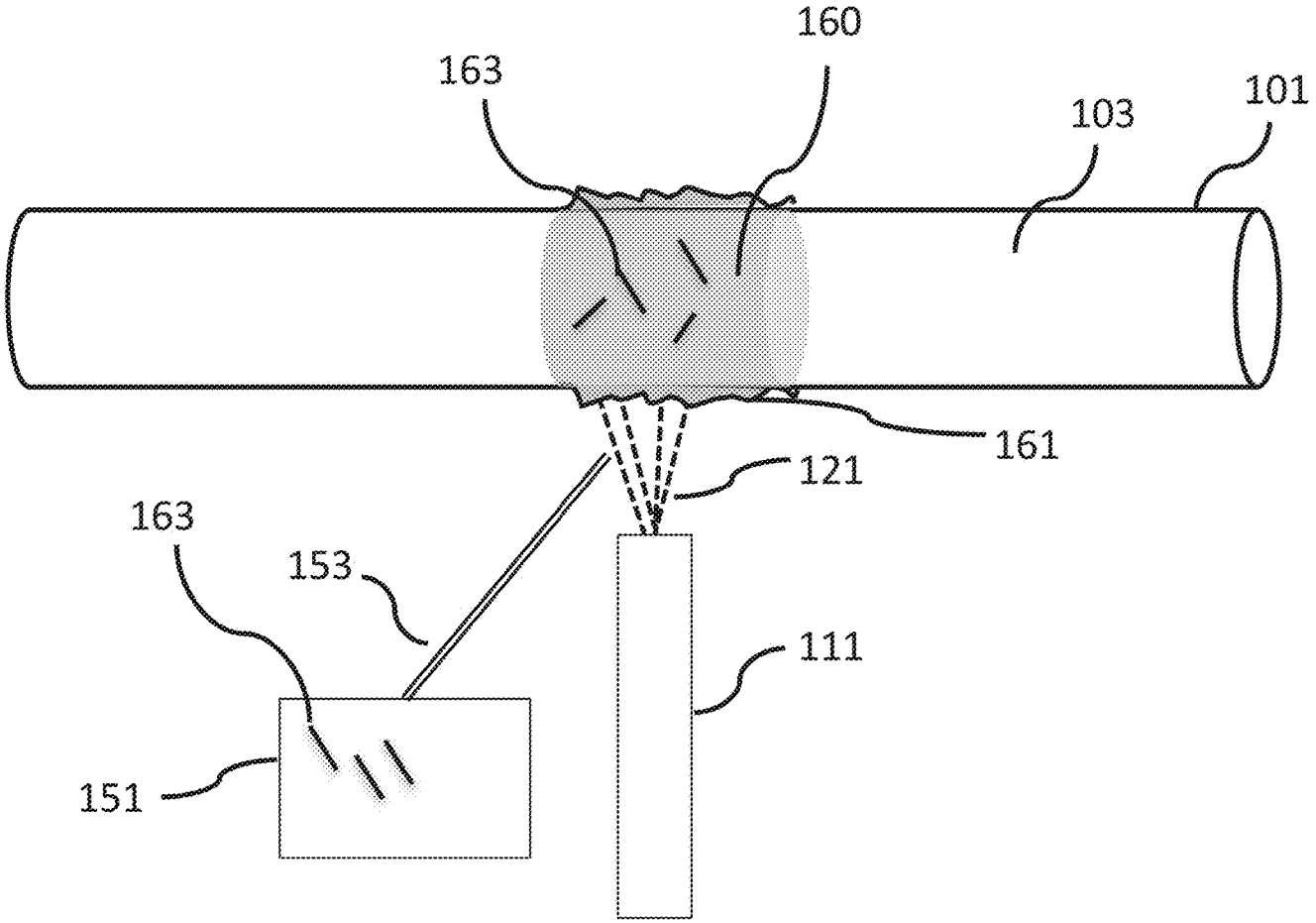
FIG. 2B illustrates a schematic diagram of a thermal spray system applying a coating to a downhole component with the use of whiskers as the reinforcing structure according to one embodiment of the present disclosure.
Figure 2C:
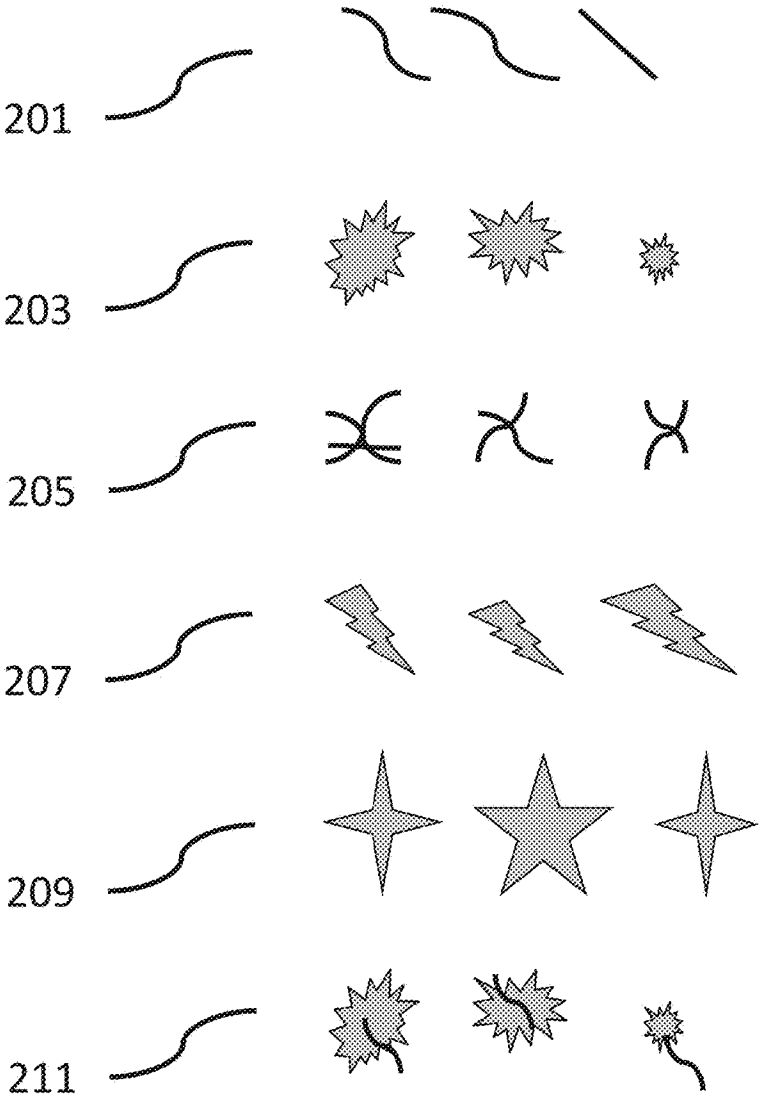
FIG. 2C illustrates various exemplary shapes of whiskers that may be used as a reinforcing structure according to one embodiment of the present disclosure.

In one embodiment as shown in FIG. 2A, the reinforcing structure (e.g., a wire) is applied directly to the tool 101 separate and/or is distinct from the thermal spraying process. In other embodiments, the reinforcing wire may be applied to the tool as part of and/or in conjunction with the thermal spraying process. For example, FIG. 2B illustrates an embodiment that uses a different type of reinforcing structure instead of a wire as illustrated in FIG. 2A. In one embodiment, the reinforcing structure of FIG. 2A includes a plurality of whiskers. For the purposes of this disclosure, whiskers are small, discrete pieces of metallic or non-metallic portions or shavings of wire, fibers, filaments, and other short lengths of material that can be inserted into an upstream portion of an air stream and blown onto an external surface of the substrate to be coated. Similar to the continuous wire described above, whiskers may comprise a wide variety of materials and/or compositions. Whiskers may be solid, cored, woven, and/or tubular. As illustrated in FIG. 2C, whiskers may comprise a variety of shapes, such as shavings 201 (which may be straight or curved), burrs 203, "jacks" 205, chips, spikes 207, and complex particles 209. In still other embodiments, whiskers may include wires or filaments pre-bonded to a powder particle, such as those illustrated as whiskers 211 in FIG. 2C. In one embodiment, the whiskers are at least 2 microns in length. For example, Haydale Technologies offers a product named the Silar whisker, which is a silicon carbide material effectively in the shape of a nanotube. As another example, Global Material Technologies offers metallic friction fibers commonly used in brake pads, and such fibers are to be considered as whiskers for the present disclosure. Such fibers may include carbon steel fibers, copper fibers, brass fibers, stainless steel, nickel alloys, and fibers of other alloys. The whiskers can be specifically made for a particular application or bought over the shelf from any number of providers. In one embodiment, the whiskers are strong, wear resistant and/or corrosion resistant materials, such as steel, stainless steel, nickel alloys, titanium, silicon carbide, carbon, graphene, and other compounds. Thus, the whiskers may be metallic or non-metallic, and come in a wide variety of sizes and shapes. The whiskers can be selected based on the desired properties of the resulting coating. For example, if a corrosion resistant coating is desired, a material or composition is chosen for the whiskers that is more resistant to corrosion for the relevant environment in which the substrate will be used.

The system described in FIG. 2B is substantially similar to the system in FIG. 2A but for the reinforcing structure utilized and application of the reinforcing structure. In particular, substrate 101 (e.g., a cylindrical downhole tool) has external surface 103 to which layers of metallic (or non-metallic) material 121 is applied by thermal spray system 111. One or more thermal spray layers 161 is formed on the external surface of the tool by metallic droplets 121 and is coupled and/or bonded to both the reinforcing structure 163 (e.g., whiskers 163) and external surface 103. A resulting coating 160 is provided on the tool surface that comprises both the reinforcing structure and the thermal spray layer(s), and is thus more durable than prior art thermally sprayed layers. Among many other benefits, this coating is more durable based in part on the properties of the whiskers, and may be resistant to impact, wear, and/or corrosion, etc. In one embodiment, the thermal spray substantially bonds with both whiskers 163 and the external surface 103 of the object to be sprayed. In other embodiments, the thermal spray substantially bonds with just whiskers 163, while in still other embodiments the thermal spray substantially bonds with just the external surface 103. In one embodiment, coating 160 does not cause significant metallurgical effects on the base material of the component and does not raise the temperature of the base material sufficiently to cause thermal damage to typical internal coatings, for example, on instrumentation and other downhole components.

Figure 1B:
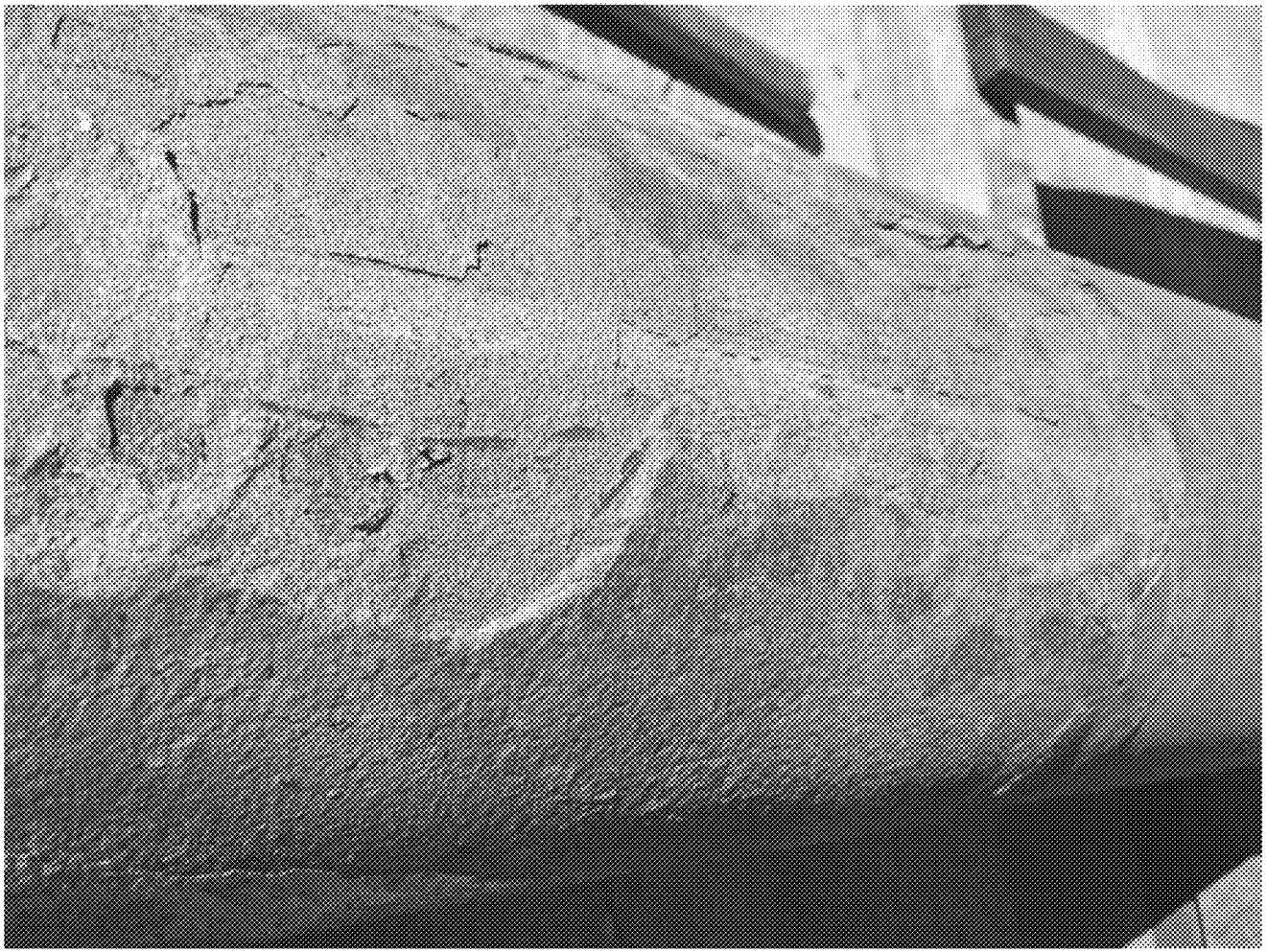
FIG. 1B (PRIOR ART)
FIG. 1B illustrates a photograph of a drill pipe with a conventional thermally sprayed layer with portions of the layer "spalled" and/or otherwise broken/fragmented off.

As illustrated in FIG. 2B, the whiskers may be delivered to the object to be coated by whisker feeder 151 in conjunction with whisker delivery tube 153. In one embodiment, whisker feeder 151 may comprise a storage bin that holds a large volume of whiskers and delivery tube 153 is sized to deliver a plurality of whiskers from the whisker feeder to substrate 101 by providing the whiskers to the spray of metallic material 121. In one embodiment, whiskers 163 get mixed with the spray stream of molten atomizing particles 121 before being delivered to the substrate. In one embodiment, whisker feeder 151 comprises a compressed air source (such as element 36 of FIG. 1) that helps propel the whiskers 163 towards the spray material 121. In another embodiment, the whiskers may be delivered and/or combined with the spray material 121 by using a conventional air source of the thermal spray system based on the proper orientating, sizing, and configuration of the delivery tube and air source.

In one embodiment, the whiskers may be delivered to the substrate in conjunction with and/or substantially at the same time as the metallic droplets applied by the thermal spray process. For example, the whiskers may be applied by introducing them to the thermal spray stream just beyond the nozzle so that they intermix with the molten spray droplets in flight. In one embodiment, while the metallic material used by the thermal spray system is melted, the whiskers are introduced into the thermal spray stream after the metallic materials have melted and are in the process of cooling. In one embodiment, the whiskers strengthen the hard spray matrix by bonding the droplets together. This bonding is similar to the concept of fiberglass, where glass fibers are intertwined in a plastic like matrix. In other embodiments, the whiskers may be delivered to the substrate prior to the thermal spray material, such as by applying an adhesive to the substrate and then blowing the whiskers onto the substrate prior to the thermal spray material. As another example, the whiskers may also be introduced in the air or gaseous pressurized stream upstream of the arc (such as a nitrogen gas), such that a portion of the whisker(s) may be melted or partially melted, thus bonding to the droplets prior to solidification. The use of a reinforcing structure in the form of whiskers allows a wide variety of substrates (and their surfaces) to be thermally sprayed, such as the inner diameter of pipes, risers, and other components that would otherwise be very difficult to wrap and/or reinforce with a wire (as seen in FIG. 2A). Other non-limiting examples include spray pads and stabilizer blades on drill motor stator housings and non-magnetic tools, etc.

In another embodiment, the reinforcing structure (or portions thereof) may be micro-welded to the substrate or pipe surface. The micro-welding may occur prior to or at substantially the same time as applying the one or more layers of thermal spray to the substrate and/or reinforcing structure. Typically, welding is not utilized on the pipe tube as standard arc welding introduces metallurgical stress risers that have led to cracks and failure of the pipe. However, micro-welding, such as capacitance discharge welding, creates a minute metallurgical discontinuity that is no larger or more detrimental than pits and scratches that are common on the pipe surface. Micro-welding is a type of welding known to one of skill in the art and may include welding performed at extremely low amperage and generally applied to small diameter wires, filaments, or whiskers, and may or may not include the use of a microscope. This micro-welding technique may be used to join and/or securely attach wire, mesh, filaments, or whiskers to the substrate surface, thus creating bonded anchors to more completely secure the coating to the substrate and provide a more durable coating.

In another embodiment, the reinforcing structure may be a mesh type structure. It is understood that a reinforcing mesh may be applied to the tool 101 rather than individually wrapped wires, filaments, or whiskers. Mesh may also include perforated tape, including both metallic and non-metallic tape. The mesh may be applied to the structure 101 as a pre-existing mesh or one or more wires/filaments may be applied to the structure 101 to make a mesh-like structure. In one embodiment, the mesh may be fed continuously from a roll, and the tool may be rotated slowly as the thermal spray gun traverses axially. The mesh can be formed of any shape, size, makeup of wires/filaments as described herein. For some objects, such as non-cylindrical objects and/or irregularly shaped objects, one or more mesh reinforcing structures may be first applied to one or more faces of the object to be thermally sprayed and then a conventional thermal spray process utilized to coat the object with a wear resistant layer.

Figure 3A:
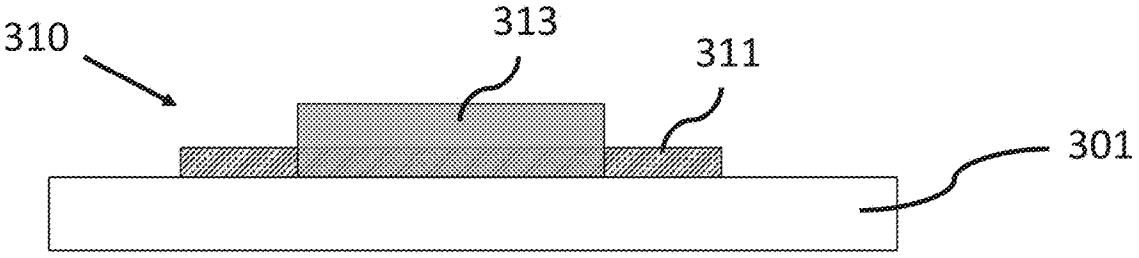
FIGS. 3A-3C illustrate various embodiments of a durable coating with a reinforcing structure and thermally sprayed layers applied to a substrate according to the present disclosure.
Figure 3B:
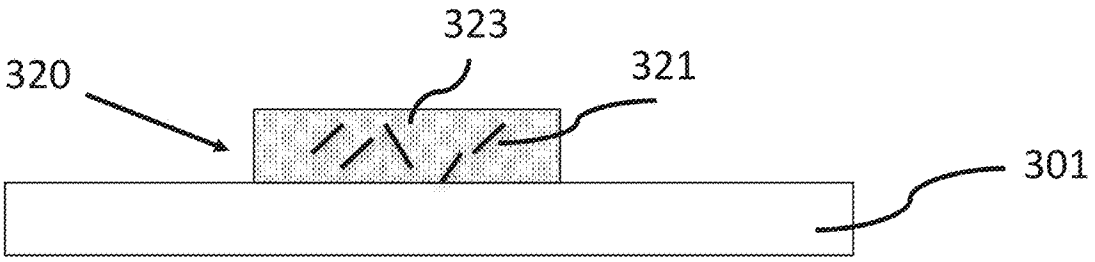
Figure 3C:
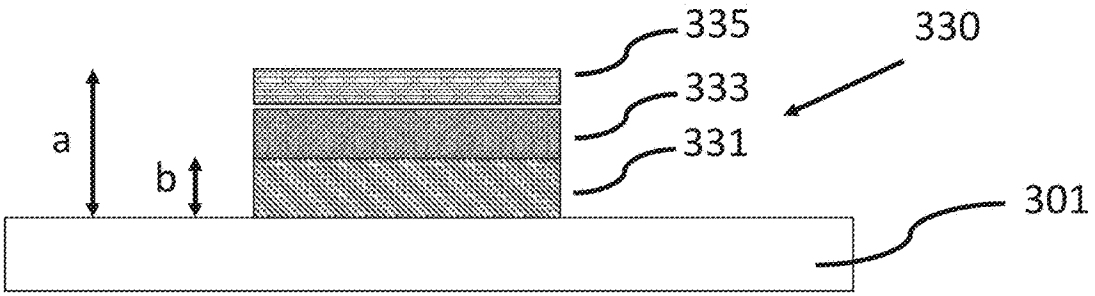

FIGS. 3A-3C illustrate various schematics of a reinforcing structure integrated with a layer of thermal spray material on a substrate to form a durable coating on the substrate.

FIG. 3A illustrates tool 301 with coating 310 that comprises reinforcing structure 311 and one or more layers of thermally sprayed metallic material 313. Reinforcing structure 311 may be a wire or mesh or similar structure. In some embodiments, multiple wires may be utilized, and each wire may be separate and different than the other wires. In one embodiment, the wire is wrapped a single time to provide a single layer of reinforcing structure around the tool. In other embodiments, the wire is wrapped multiple times to provide multiple layers or levels of reinforcing structure. After wire 311 is wrapped around the tool the desired thickness and amount, a layer 313 of metallic material is thermally sprayed onto the tool and/or reinforcing structure. As is known in the art, layer 313 itself may be formed of multiple passes or layers of thermally sprayed material. In one embodiment, the metallic material bonds and/or couples to either or both of the reinforcing structure and/or a surface of the tool. Multiple layers of thermal spray may be applied to create the desired thickness of coating 310. In one embodiment, reinforcing structure 311 comprises a first thickness and the layer of metallic material 313 comprises a second thickness. In one embodiment, the overall thickness of coating 310 may be measured as the total thickness of the reinforcing structure and layer(s) of metallic material. In other embodiments, a first layer of reinforcing structure and metallic material may be applied to the tool, followed by a second, separate layer of reinforcing structure and metallic material, and so on. Each layer may have the same or a different thickness and composition.

FIG. 3B illustrates tool 301 with coating 320 that comprises a reinforcing structure and a layer of thermally sprayed metallic material. Reinforcing structure 321 may be a plurality of whiskers that are integrated within the layer of thermal spray material 323. In one embodiment, the whiskers 321 may be combined with a layer of spray material prior to being deposited on the substrate (such as shown in FIG. 2B). In one embodiment, the metallic material of the thermal spray bonds and/or couples to either or both of the whiskers and/or the tool. Multiple layers of thermal spray (with the integrated whiskers) may be applied to create the desired thickness of coating 320.

FIG. 3C illustrates one schematic of a coating that comprises a plurality of different and distinct layers or coatings. For example, coating 330 may comprise first coating or layer 331, second coating or layer 333, and third coating or layer 335. Each layer may have the same or a different thickness and composition. For example, layer 331 has a thickness "b," which is greater than the thickness of layers 333 and 335. The overall thickness of coating 330 is thickness "a," which may be measured as the total thickness of each of the layers. In one embodiment, first layer 331 may have a first composition or arrangement of a first reinforcing structure, second layer 333 may have a second composition or arrangement of a second reinforcing structure, and third layer 335 may have a third composition or arrangement of a third reinforcing structure. Likewise, the first layer may have a first composition of metallic material and the second layer may have a second composition of metallic material and the third layer may have a third composition of metallic material. In these embodiments, while the first layer may be bonded to the base material of the tool, the second and additional layers may only be bonded with adjacent layers and not bonded directly to the base material of the tool. In one embodiment, the coating is deposited on the substrate independent of significant metallurgical changes to the substrate. In one embodiment, the coating demonstrates greater wear and/or impact resistance than a thermally sprayed substrate without the one or more reinforcing structures. In another embodiment, the coating comprises a corrosion resistant layer. In one embodiment, different layers of thermal spray coatings may be applied, wherein each layer has a different type of whisker and/or reinforcing structure. For example, an outer layer may resist wear and an inner layer may resist corrosion. In other embodiments, a first layer may be substantially impact resistant and a second layer may be substantially resistant to corrosion. In other embodiments, some of the layers may not comprise a reinforcing structure, and some of the layers may contain non-metallic material. In one embodiment, each of the layers of reinforcing structure and/or metallic material is applied to the tool in individual steps/procedures.

In one embodiment, the present disclosure provides a thermally sprayed coating on a substrate that comprises one or more layers of thermally sprayed metallic material on a substrate and one or more reinforcing structures embedded within the layer of the thermally sprayed metallic material. The reinforcing structure may comprise a wide variety of materials, such as wire, whiskers, mesh, etc., and may be metallic or non-metallic. The coating may comprise only one layer of a thermally sprayed material and reinforcing structure, or as illustrated in FIG. 3C may comprise a plurality of different layers. If different layers are utilized within the coating, each layer may have a different composition, material, reinforcing structure, and/or thickness. For example, a first layer may use wire as the reinforcing structure at a thickness of thermal spray of approximately 0.040" to 0.080", and a second layer may use whiskers as the reinforcing structure with a thickness of thermal spray of approximately 0.020" to 0.060", thereby creating an overall coating thickness of between approximately 0.060" to 0.140." Of course, other variations and thicknesses are possible. In the case of stabilizer blades on drill motors, heavy weight drill pipe or building of stabilizer tools, the thickness may be up to 3.0."

The thickness of the coating varies based on the desired characteristics of the coating (wear resistance, impact resistance corrosion resistance, etc.), the intended application of the coated tool/substrate, and the utilized reinforcing structure. In one embodiment, the total coating thickness may be generated in multiple passes. In one embodiment, the coating may be applied in thick deposits exceeding 0.100", although ranges in the amount between 0.020" up to 3.0" are possible. The coating thickness (and/or each separate layer of the coating) may be relatively thin such as between 0.002" to 0.020", or bigger between 0.020" to approximately 0.100", or even greater thicknesses such as approximately 0.35", 0.50", or more. For example, U.S. Pat. No. 7,487,840 (the "840 patent") discloses an iron based coating that is at least 0.100" thick. The disclosed coating (with integrated reinforcing structure) may be less than 0.100" thick (such as approximately 0.090" or less), approximately 0.100" thick, or greater than 0.100" thick. In some embodiments, while the thickness of the coating may be approximately 0.100", the layer of thermal spray within the coating may be substantially less than 0.100" as the reinforcing structure may account for a considerable amount of the thickness of the coating. For example, the reinforcing structure may be at least ⅛, ¼, or up to ½ (or more) of the thickness of the overall coating. Thus, in one embodiment, a coating may be made that is approximately 0.100" or more but with significantly less thermal spray material (and a corresponding less thick thermal spray layer) than traditionally required.

For example, the coating may be applied to a 4.00" OD drill pipe with an approximately 0.090" thermal spray layer/ coating. The diameter of the wire used as the reinforcing structure may be approximately 0.006". The resulting thickness of the total coating may be approximately 0.100" based on the combination of the reinforcing structure/wire and the thermal spray material. In another embodiment, a wire may be used that is approximately 0.020" thick and the thickness of the thermal spray may be approximately 0.060" to 0.080" thick, creating an overall thickness of the coating to be approximately 0.080" to 0.100" thick. Other variations are possible based on the intended surface (and tool) to be coated, the reinforcing structure to be utilized, and the application/environment of the coated tool. In still other embodiments, a given amount of thermal spray may be added (such as 0.090") to a substrate and the thickness of the coating may be varied based upon the amount of reinforcing structure added.

As described herein, the disclosed coating (e.g., one or more reinforcing structures integrated and/or embedded within one or more layers of thermal spray) can be applied to a wide range of substrates. The substrate may be substantially flat or cylindrical. While an embodiment of the disclosure is directed to drill pipe or other downhole components used in the oil and gas industry, the novel reinforcing structure embedded in a thermally sprayed layer of metallic material can be used in a variety of applications and industries. For example, the disclosed coating may be used for many other downhole components in the oil and gas industry, such as but not limited to drill pipes, drill pipe tool joints, heavy weight pipes, stabilizers, cross-overs, jars, MWDs, LWDs, drill bit shanks, etc. The disclosed coating may also be used on objects other than downhole components where an increased impact resistant, wear resistant, and/or corrosion resistant layer is needed, such as dredge pumps, cable sheaves, helicopter landing runners, etc., including the automotive, aviation, and marine industries. The reinforcing layer may also be used as hard banding to rigidly attach separate components, such as around drill pipe tool joints.

Methods of Use

As described above, the present disclosure is generally directed to forming a durable coating on a substrate that includes one or more reinforcing structures and one or more layers of thermally sprayed material. In general, the methods of thermal spray are well known in the relevant art and a variety of different thermal spray techniques may be utilized. In one embodiment, to apply a thermal spray coating for a tool the following steps may be generally taken as is known in the art: (i) provide the necessary consumables and equipment, (ii) prepare the tool to be coated, (iii) clean and/or degrease the tool, (iv) sand blast the tool, (v) thermally spray the tool, and (vi) store the tool. In addition, for the present disclosure, a reinforcing structure needs to be attached to the tool, embedded within the thermal spray layer, and/or coupled to the thermal spray particles or securely attached to the substrate via micro-welding or similar techniques.

In use, the disclosed thermal spray layer with reinforcing structure may be applied to a wide variety of components by a variety of methods. In one embodiment, the method includes providing a substrate or other object to be coated (which has an external surface), attaching and/or otherwise coupling one or more reinforcing structures to at least a portion of the external surface, and thermally spraying a layer of material (such as atomized melted metal) on the external surface. In another embodiment, the method includes embedding one or more reinforcing structures into the thermal spray layer around the substrate.

Figure 4:
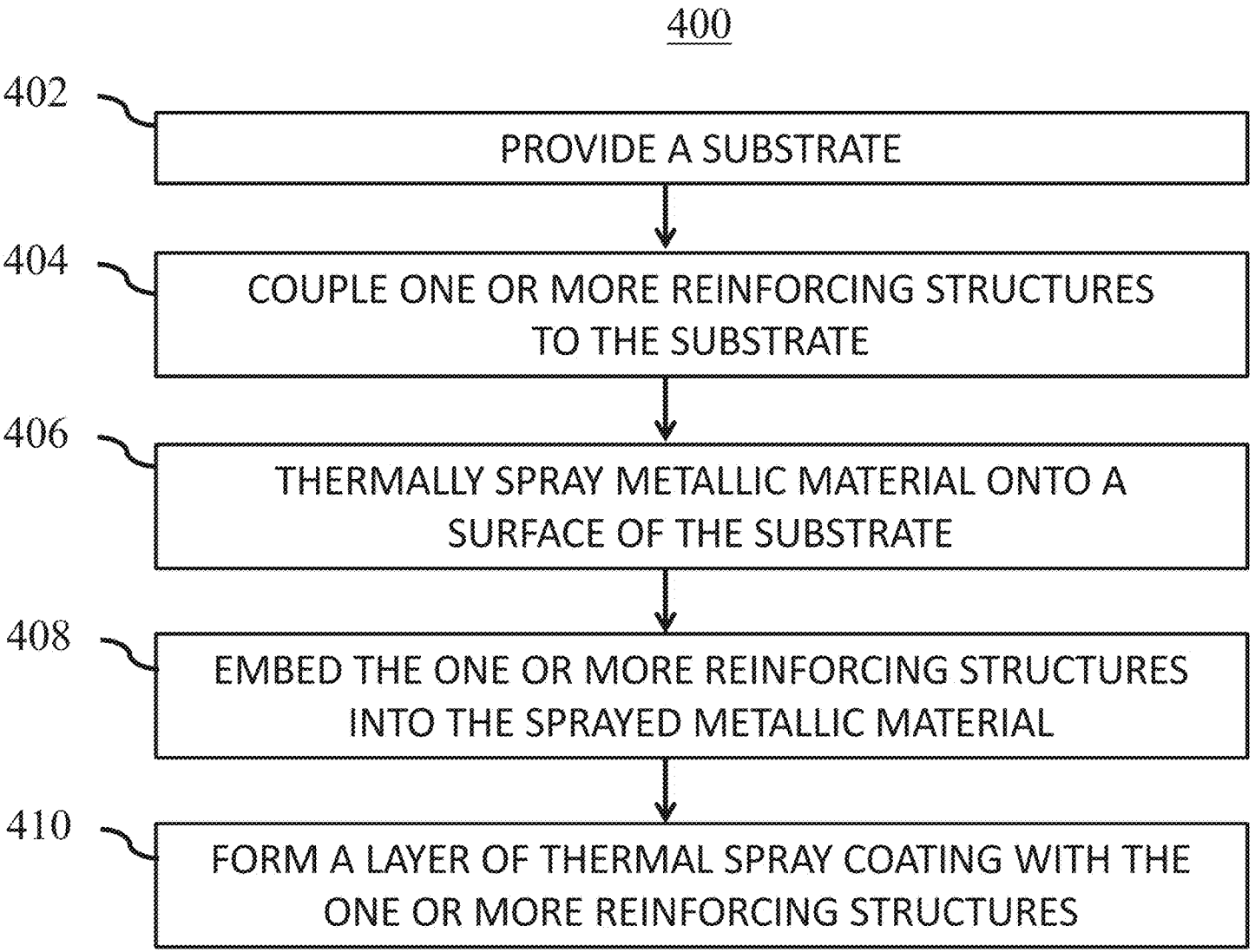
FIG. 4 illustrates one method for forming a thermal spray coating with a reinforcing structure according to one embodiment of the present disclosure.

FIG. 4 provides one exemplary method 400 of forming a coating on a substrate. Step 402 comprises providing a substrate, which typically comprises an external surface. The substrate can be any shape, size, or configuration, and is not limited to downhole tools or cylindrical objects. Step 404 comprises coupling one or more reinforcing structures to the substrate. The reinforcing structure may be a wire, mesh, whisker, etc., and may be metallic or non-metallic and be any other similarly sized and shaped reinforcing component that can bond with a thermally sprayed layer. The coupling step may comprise attaching a reinforcing structure (such as wire or mesh) to the substrate or wrapping the reinforcing structure around the substrate. The coupling step may comprise inserting and/or delivering the reinforcing structure to the substrate separate from or in conjunction with the thermal spray material (such as in the instance of blown whiskers). The coupling step may also comprise securely attaching the reinforcing structure to the substrate using micro-welding or similar techniques.

If a wire is used as the reinforcing structure, coupling step 404 may further comprise wrapping the wire around the tool to be coated. In one embodiment, thermal resistant tape may be used to initially attach the reinforcing wire to the substrate surface. For example, the tape may be attached approximately 4" away from the coating area. In one embodiment, a storage bin or roll of wire is placed near the tool to be coated and based on rotation of the tool, the wire is automatically drawn from the wire storage roll and wrapped around the tool. If the tool to be coated is a pipe or other cylindrical object, the substrate can be rotated in the direction of pulling the wire forwardly. For thermal spray and wire wrapping, the pipe should be rotated in the correct direction and at the correct speed. In one embodiment, the reinforcing wire should be wrapped around the tool such that there is at least a 1/16 inch gap between each adjacent wire, which allows a portion of the thermal spray material to contact and/or bond with the exterior surface of the tool in addition to the wire. In other embodiments, the gap between the adjacent reinforcing wire may be as large as 1/8 or 1/4 inches. If the gap is too large, the rotation speed of the pipe should be increased; if the gap is too small, the rotation speed of the pipe should decrease. In one embodiment, all of the wire is wrapped around the tool to be coated prior to the thermally spraying step, and the end of the wire is taped at approximately 4" away from the area to be coated. One of ordinary skill in the art will recognize that other coupling steps may be performed, depending on the type and amount of reinforcing structure desired and ultimate coating properties.

In one embodiment, the coupling step comprises attaching the reinforcing wire to the pipe just outside the application area, and the pipe is rotated pulling the wire around it through a wire guide that is attached to the spray gun, which is automatically traversing coaxially to the pipe and about 6" away from the pipe. The spray gun may be mounted to a traversing machine that automatically reverses direction when the specified width is accomplished. In one embodiment, the system lays down about 0.010" thickness per thermally sprayed layer. Once several layers of reinforcing wire and spray metal are completed the reinforcing wire may be cut and only spray metal applied to the final layers to create a smoother finish. In another embodiment, the reinforcing wire may be applied where one or more wires travel coaxially at a faster rate than the spray gun, such that it is applied to the pipe at a greater angle and thus creates a cross-hatched pattern as subsequent layers are built up. This embodiment may strengthen the thermal spray deposit when the pipe experiences high torsional loads when drilling an oil or gas well.

Step 406 comprises thermally spraying metallic material onto a surface of the substrate, such as the external surface. Any variety of thermal spray techniques may be used, and it is not limited to a conventional twin-wire thermal spray. The reinforcing structure may already be applied to the substrate prior to delivering the thermal spray material (such as by taping, adhesion, micro-welding, wrapping, etc.), or the reinforcing structure may be deposited with the thermally sprayed material onto the substrate at approximately the same time (such as by blown whiskers). In one embodiment, once the correct rotation speed of the tool is achieved, the thermal spray equipment may be turned on and material (whether metallic or non-metallic) thermally sprayed on the exterior surface of the tool and/or wire wrap. In some embodiments, multiple layers of reinforcing structure may be applied to the tool prior to thermal spray. In other embodiments, wire may be wrapped (or another reinforcing structure applied) at approximately the same time as the thermal spray step.

Step 408 comprises embedding the one or more reinforcing structures into the sprayed metallic material. In the example of reinforcing wire, this step may include spraying the metallic material to both the substrate and the reinforcing wire to create a bond between the reinforcing wire and the thermal spray material. Thus, the embedding step may be a result of thermally spraying the metallic material onto both the substrate and the reinforcing wire to create the necessary thickness. In the example of reinforcing whiskers, this step may include coupling the delivered whiskers with the stream of thermal spray prior to depositing the combined whisker/thermal spray stream onto the substrate. In some embodiments, the whiskers bond with (or at least start bonding with) the thermal spray material in flight towards the substrate. In other embodiments, the whiskers merely get mixed up with the thermal spray material and do not bond with the thermal spray material until it transforms from the plastic or near molten state to full solidification on the substrate.

Step 410 comprises forming a layer of thermal spray coating to the tool, which may include spraying the thermal spray layers onto the reinforcing structure and/or tool. In some embodiments, as is known in the art, multiple passes of thermal spray may be applied to the reinforcing wire and/or tool to create the desired thickness of coating and/or thermal spray layers. For example, 5 to 300 passes of thermal spray layers may be needed to create the desired thickness. In still other embodiments, the coating may be created by multiple, distinct levels of thermal spray. For example, a first coating thickness may be created by a first wrapping of wire (or other reinforcing structure) following by multiple passes of thermal spray, and a second coating thickness may be created by a second wrapping of wire (or other reinforcing structure, such as whiskers) followed by multiple passes of thermal spray.

EXAMPLES

Various tests show that a reinforcing structure (such as wire) of the present disclosure holds the thermal sprayed deposit together during severe impact and provides significant durability increases of the thermally sprayed layer as compared to prior art coatings. One test, known as the drop-weight test, imparts a near point load under controlled conditions by releasing a rectangular weight from a given height. The same test parameters can be used on different materials to evaluate the materials under the same test. The weight used for the present tests includes a rectangular weight weighing approximately 50 pounds with a 2" diameter round bar on the bottom so that it impacts the pipe specimen approximately 90 degrees from the pipe axis.

Figure 5B:
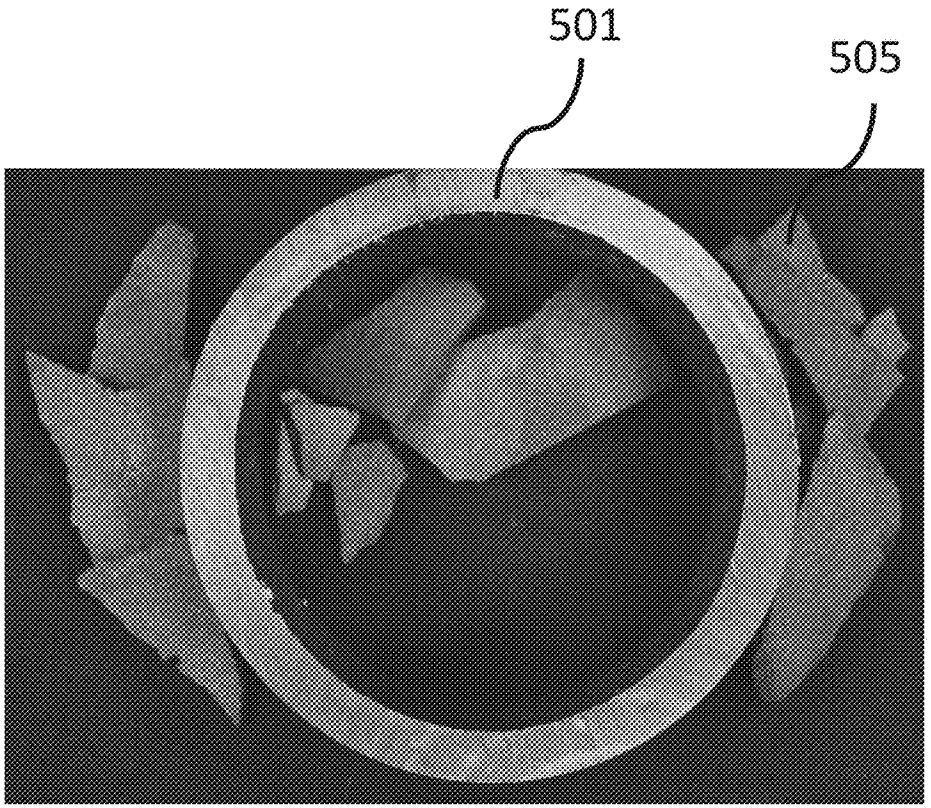
FIG. 5B illustrates a cross-sectional view of a drill pipe with metallic material applied by conventional thermal spray after impact to the external surface of the drill pipe.
Figure 6B:
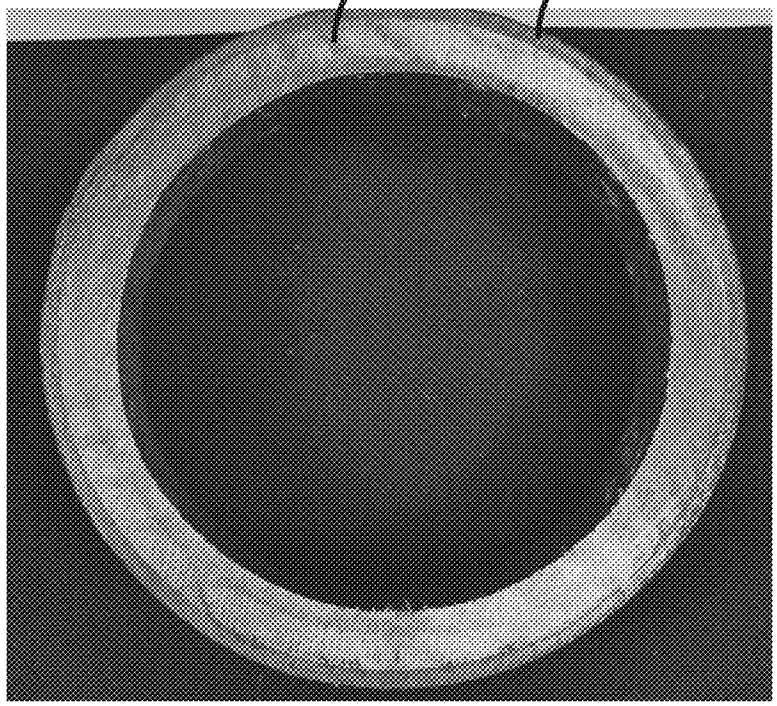
FIG. 6B illustrates a cross-sectional view of a drill pipe with metallic material applied over embedded wire on the drill pipe by thermal spray after impact to the external surface of the drill pipe.

Drop weight tests were performed on (1) conventional thermally sprayed layers (see, e.g., FIG. 5B) and (2) thermally sprayed layers with reinforcing wire (see, e.g., FIG. 6B). Illustrated pictures show before and after impact for comparison purposes.

Figure 5A:
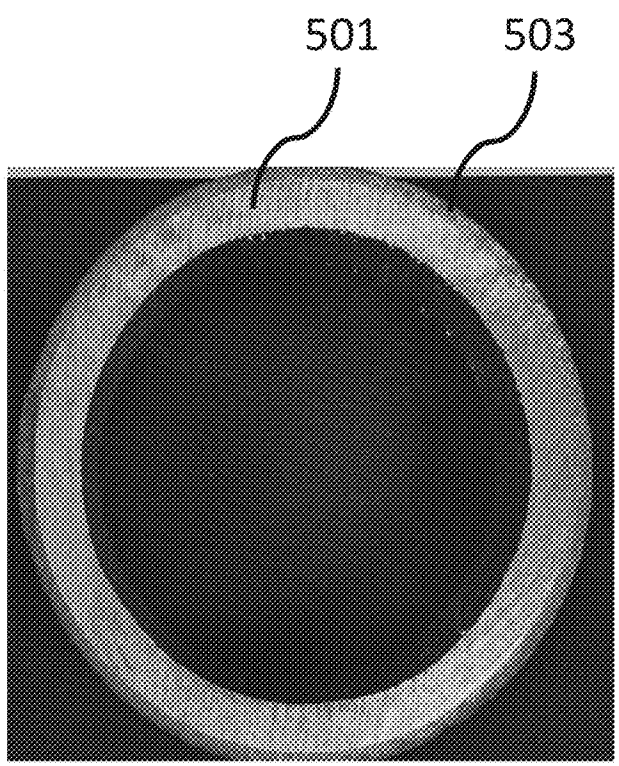
FIG. 5A illustrates a cross-sectional view of a drill pipe with metallic material applied by conventional thermal spray without impact to the external surface of the drill pipe.

FIGS. 5A and 5B illustrate a cross-sectional view of drill pipe with a conventional thermal spray. The drill pipe 501 in this test was 4" AISI 4137 alloy steel. The thermal spray process was a twin-wire thermal spray as disclosed in U.S. Pat. No. 7,487,840. No reinforcing structure (such as a wire, filament, or mesh) was utilized. FIG. 5A illustrates a cross-sectional view of a drill pipe with metallic material applied by conventional thermal spray process without impact to the external surface of the drill pipe. The resulting thickness of the thermally sprayed layer 503 shown in FIG. 5A is approximately ⅛ inches. FIG. 5B illustrates a cross-sectional view of a drill pipe with metallic material applied by conventional thermal spray process after impact to the external surface of the drill pipe. The impact is a result of the 50-pound drop test described above. As shown, after impact the thermal spray layer 503 is shattered and/or broken into various parts, such as layer fragments 505.

Figure 6A:
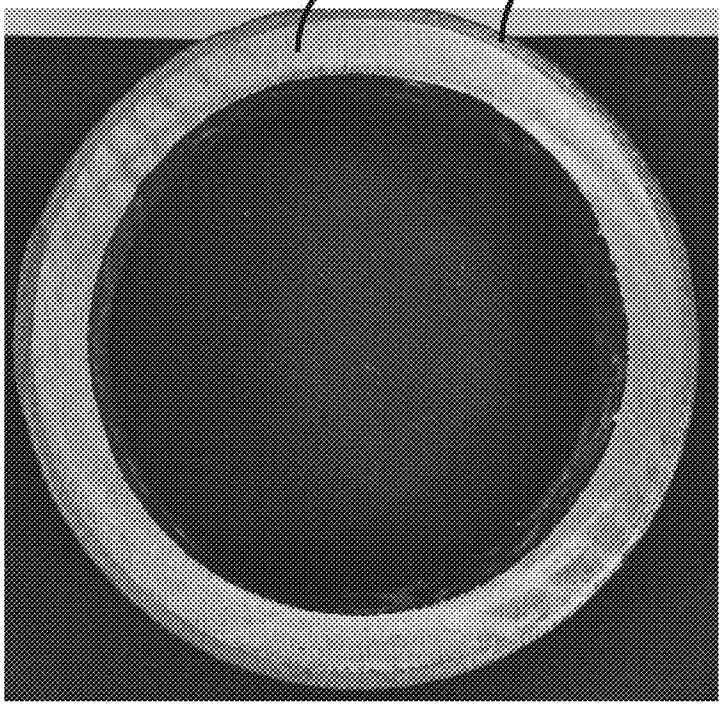
FIG. 6A illustrates a cross-sectional view of a drill pipe with metallic material applied over embedded wire on the drill pipe by thermal spray without impact to the external surface of the drill pipe.

FIGS. 6A and 6B illustrate a cross-sectional view of drill pipe with a conventional thermal spray applied over a reinforcing wire as presently disclosed. The drill pipe 601 in this test was 4" AISI 4137 alloy steel. The thermal spray process was a twin-wire thermal spray as disclosed in U.S. Pat. No. 7,487,840. The reinforcing wire was a 1/16" diameter metallic steel wire applied circumferentially over the drill pipe. The thermal spray was applied simultaneously as the reinforcing wire was wrapped around the drill pipe. FIG. 6A illustrates a cross-sectional view of a drill pipe with metallic material applied over embedded wire on the drill pipe by thermal spray without impact to the external surface of the drill pipe. The resulting thickness of the thermally sprayed layer 603 (with embedded reinforcing wire) shown in FIG. 6A is approximately ⅛ inches. FIG. 6B illustrates a cross-sectional view of a drill pipe with metallic material applied over embedded wire on the drill pipe by thermal spray after impact (e.g., the 50-pound drop test described above) to the external surface of the drill pipe. As shown, and in contrast to a conventional thermally sprayed layer as shown in FIG. 5B, thermal layer 603 remains substantially intact after impact.

Figure 7B:
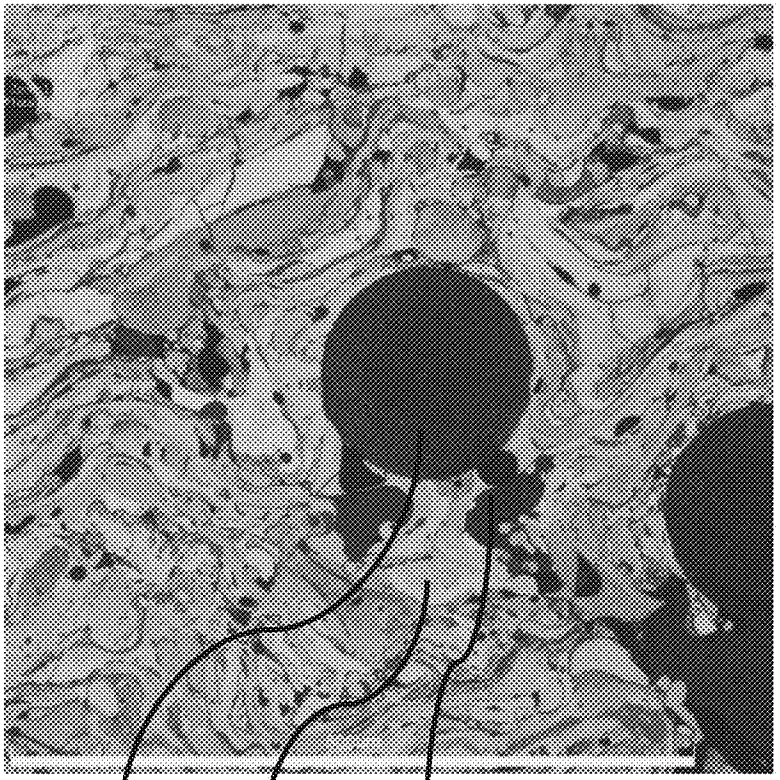
FIGS. 7A and 7B illustrate a cross-sectional view of a layer of metallic material applied by thermal spray over embedded wire on a drill pipe without impact to the layer, at a magnification of 70× and 500×, respectively.
Figure 7A:
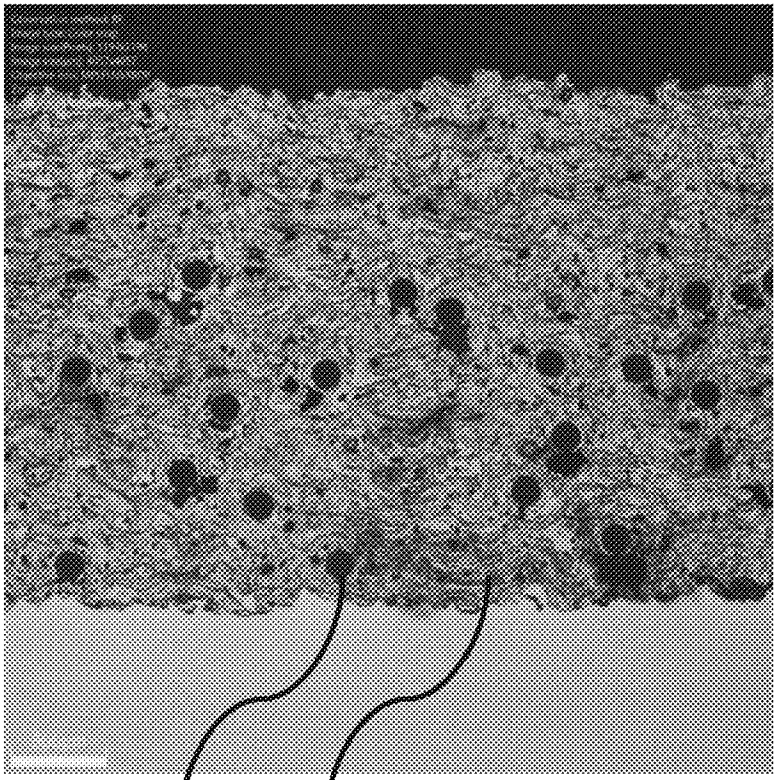

Various cuts of the drill pipe and thermal layer illustrated in FIGS. 6A and 6B were captured at various magnifications to analyze the bonding of the thermally sprayed layer to the surface of the drill pipe and the reinforcing wire. Magnified views of these cuts are illustrated in FIGS. 7-10. FIGS. 7A, 7B (no impact) and FIGS. 8A, 8B (after impact) show a cross-sectional view of a thermally sprayed layer with reinforcing wire. FIGS. 9A, 9B (no impact) and FIGS. 10A, 10B (after impact) show a longitudinal view of a thermally sprayed layer along the length of its reinforcing wire.

FIGS. 7A and 7B illustrate a cross-sectional view of a layer of metallic material applied by thermal spray over embedded wire on a drill pipe without impact to the layer, at a magnification of 70× and 500×, respectively. As shown in FIG. 7A, a thickness 703 of the coating is illustrated with various cross sections of reinforcing wire 705 embedded within thermally sprayed metallic material 707. As shown in FIG. 7B, which shows a magnified view of the bonding around the reinforcing wire 705, the thermally sprayed layer 707 adheres to a substantial portion of the edges/surface of the reinforcing wire 705. Relatively few voids 709 are present around the wire, illustrating a substantially complete bonding of the thermal layer to the reinforcing wire. The shape/diameter of the reinforcing wire is substantially the same and is not materially altered as a result of the applied thermal spraying layer.

Figure 8B:
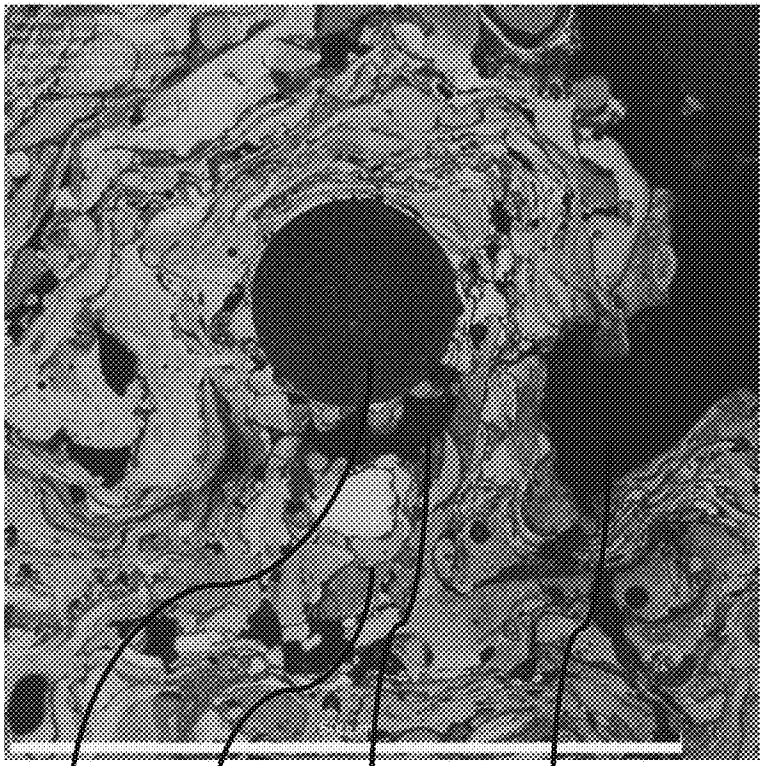
FIGS. 8A and 8B illustrate a cross-sectional view of a layer of metallic material applied by thermal spray over embedded wire on a drill pipe after impact to the layer, at a magnification of 70× and 500×, respectively.
Figure 8A:
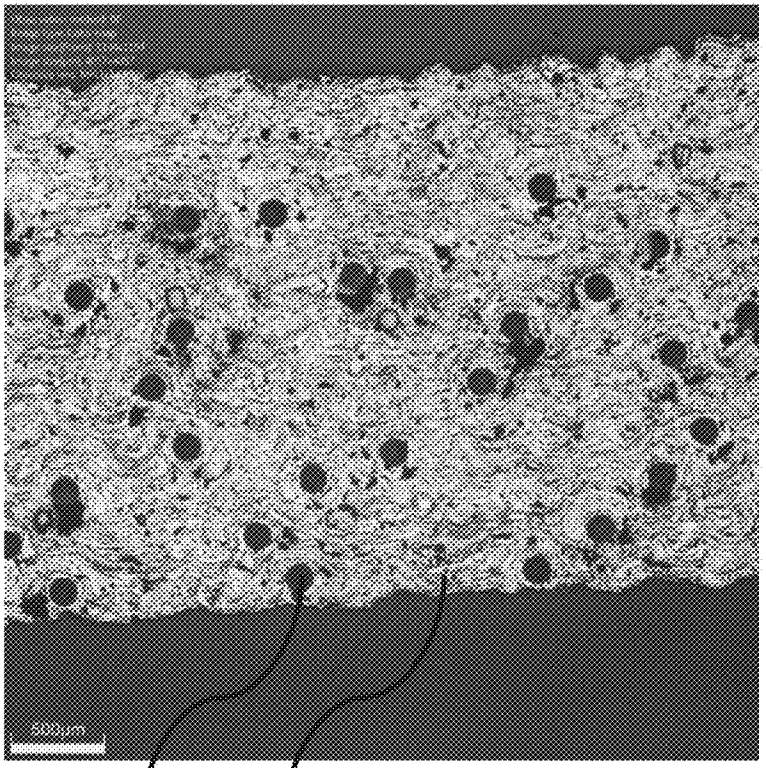
Figure 9B:
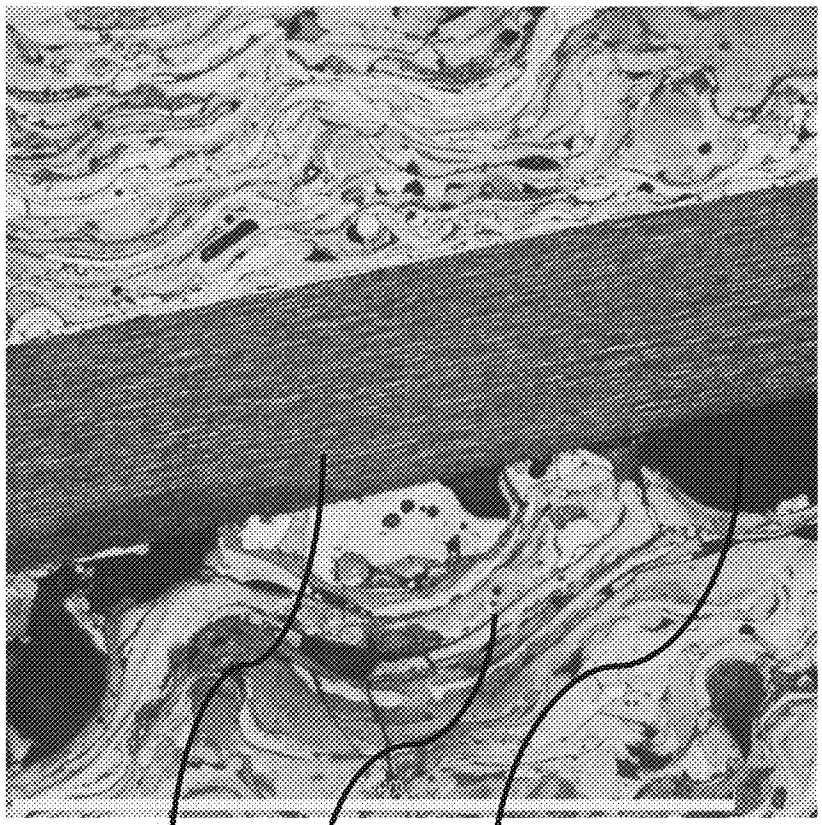
FIGS. 9A and 9B illustrate a longitudinal view (along the wire) of a layer of metallic material applied by thermal spray over embedded wire on a drill pipe without impact to the layer, at a magnification of 70× and 500×, respectively.
Figure 9A:
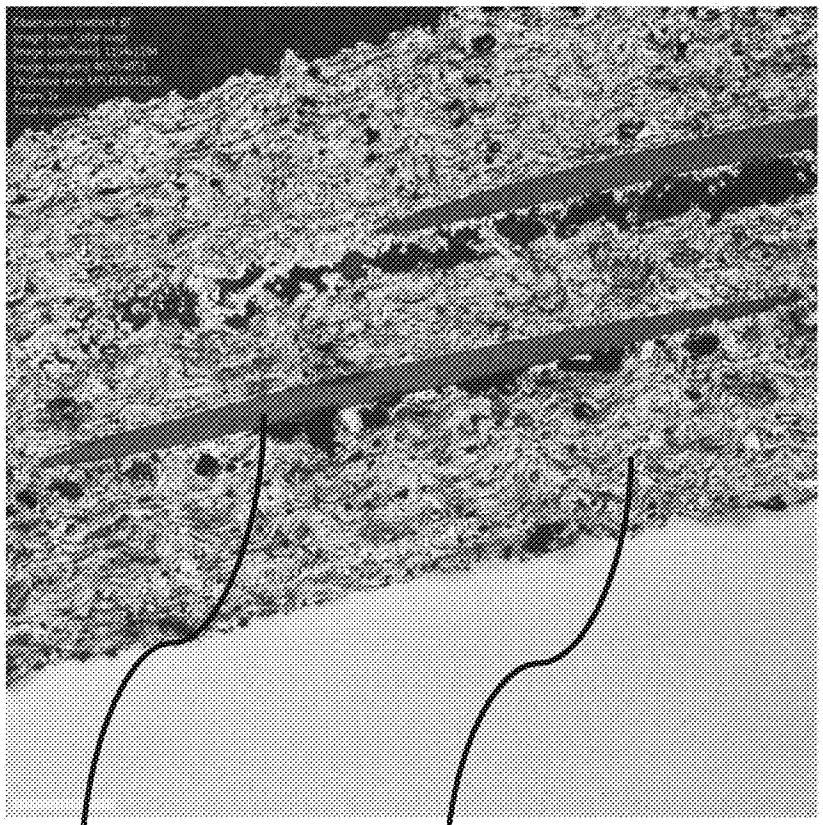

FIGS. 8A and 8B illustrate a cross-sectional view of a layer of metallic material applied by thermal spray over embedded wire on a drill pipe after impact to the layer, at a magnification of 70× and 500×, respectively. Similar to the non-impact views shown in FIGS. 7A and 7B, after impact the thermally sprayed layer 707 remains substantially bonded to the reinforcing wire 705 and there are relatively few voids or cracks 709 in the thermally sprayed layer around the reinforcing wire. After impact, additional fractures 711 may be occasionally formed in the layer 703, but the thermal layer retains its overall structure that displays an increased resistance to impact, breaking, and fracture as compared to thermally sprayed layers without reinforcing wire.

FIGS. 9A and 9B illustrate a longitudinal view (along the wire) of a layer of metallic material applied by thermal spray over embedded wire on a drill pipe without impact to the layer, at a magnification of 70× and 500×, respectively. Similar to FIGS. 7A and 7B, the thermally sprayed layer 907 adheres to a substantial portion of the edges/surface of the reinforcing wire 905. Relatively few voids 909 around the wire are present, illustrating a substantially complete bonding of the thermal layer to the reinforcing wire. The shape/diameter of the reinforcing wire is substantially the same and is not materially altered as a result of the thermal spraying layer.

Figure 10B:
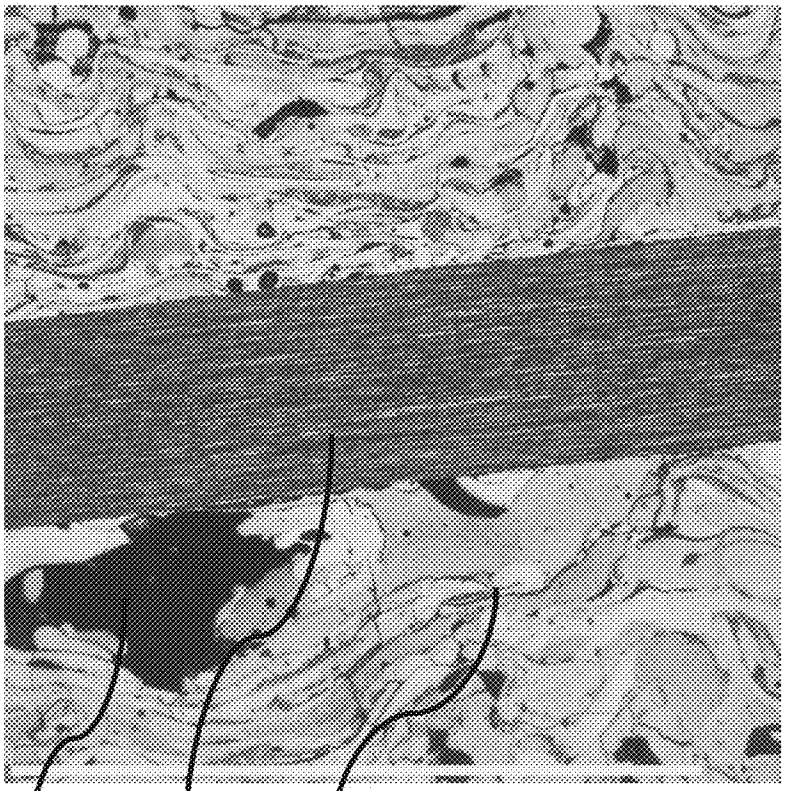
FIGS. 10A and 10B illustrate a longitudinal view (along the wire) of a layer of metallic material applied by thermal spray over embedded wire on a drill pipe after impact to the layer, at a magnification of 70× and 500×, respectively.
Figure 10A:
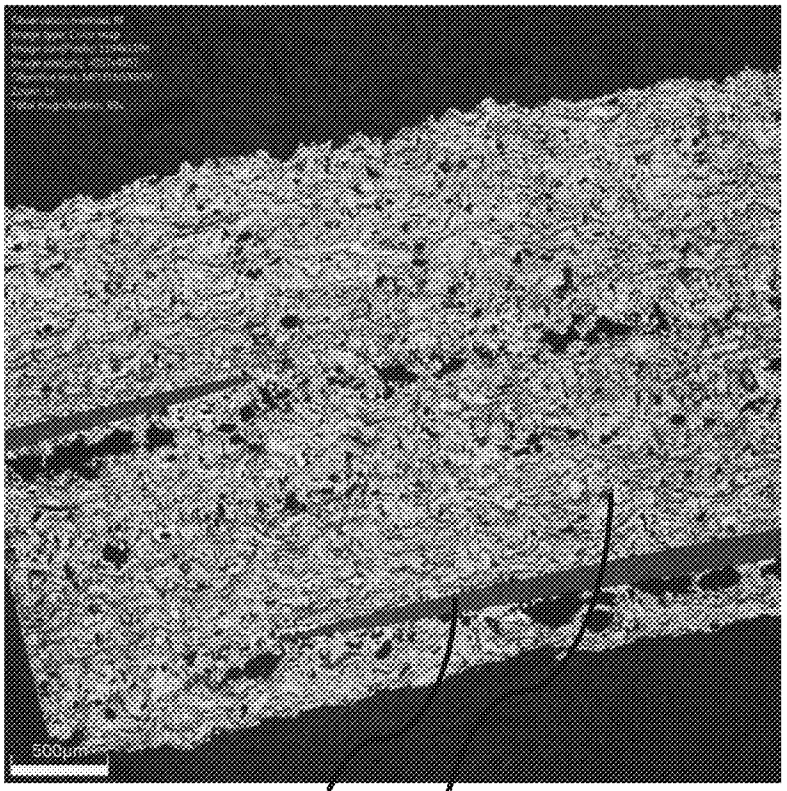

FIGS. 10A and 10B illustrate a longitudinal view (along the wire) of a layer of metallic material applied by thermal spray over embedded wire on a drill pipe after impact to the layer, at a magnification of 70× and 500×, respectively. Similar to the non-impact views shown in FIGS. 9A and 9B, after impact the thermally sprayed layer 907 remains substantially bonded to reinforcing wire 905 and there are relatively few voids or cracks 909 in the thermally sprayed layer around the reinforcing wire.

In general, the specimens with reinforced wire exceeded all previous heights without cracking, which is due to the reinforcing nature of the embedded wires in the thermally sprayed layers. The reinforcing wire adds protection from spalling in an impacted area or where a crack has developed. The reinforcing wire adds strength to the thermally sprayed layer and arrests and prevents formation of cracks. The reinforcing wire prevents crack formation both radially and longitudinally in the thermally sprayed layer. In one embodiment, the reinforcing wire (or other reinforcing structures) acts similar to rebar in concrete, which not only prevents cracks but reduces propagation of any developed cracks.

Figure 11:
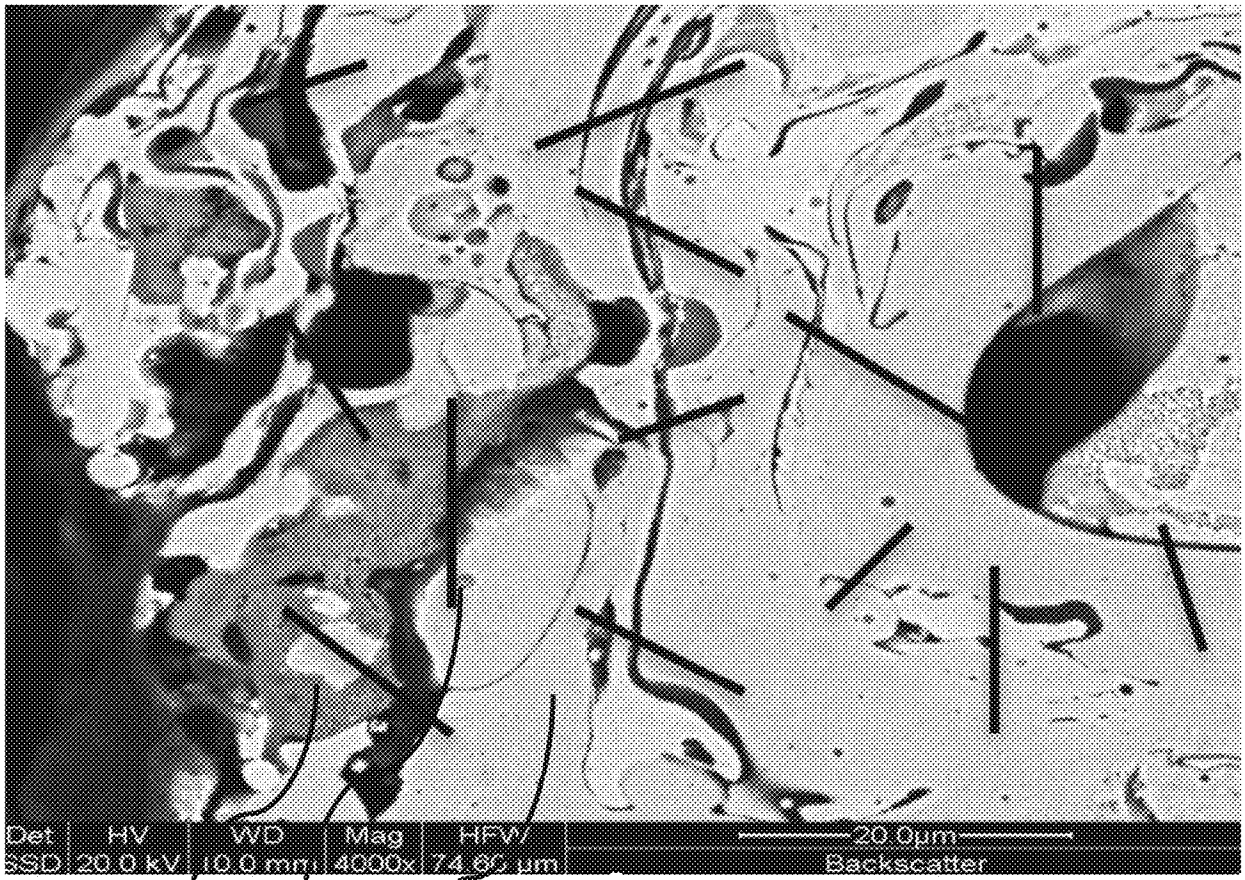
FIG. 11 illustrates a hypothetical cross-sectional view of a layer of metallic material with integrated reinforcing structure (e.g., whiskers) applied by thermal spray on a drill pipe, at a magnification of 4000×.

FIG. 11 illustrates a hypothetical cross-sectional view of a layer of metallic material with integrated reinforcing structure (e.g., whiskers) applied by thermal spray on a drill pipe, at a magnification of 4000×. FIG. 11 illustrates whiskers 1105 (e.g., discrete pieces of wire) that are partially imbedded into the thermal spray 1107 and across the droplet boundaries thus tying them together. In one embodiment, the whiskers may cross cracks and/or voids 1109, and other non-homogenous sections of the thermally sprayed layers to better tie the thermal sprayed layer together.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Many other variations in the system are within the scope of the invention. For example, the tool to be coated can be cylindrical or non-cylindrical. The reinforcing structure applied to the tool can be one or more metallic and/or non-metallic wires, whiskers, filaments, and/or mesh structures. The tool to be coated may be a downhole component or other tool used in the oil and gas industry, or may be applied to any object or tool that needs an increased impact and/or wear resistant layer or friction reduction layer or corrosion resistant layer, such as in the aviation and marine industries, as well as dredge pups, cable sheaves, and helicopter landing runners, among others. The disclosed technology is applicable to both corrosion resistant overlays as well as wear resistant applications. It is emphasized that the foregoing embodiments are only examples of the very many different structural and material configurations that are possible within the scope of the present invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. A method for forming a coating on a substrate, comprising:

providing a substrate having an external surface;

thermally spraying a layer of metallic material on the external surface;

embedding one or more reinforcing structures into the thermal spray layer, wherein the one or more reinforcing structures comprises mesh; and coupling the one or more reinforcing structures to the external surface during the thermally spraying step.

2. The method of claim 1, further comprising coupling the one or more reinforcing structures to the external surface prior to the thermally spraying step.

3. The method of claim 1, further comprising wrapping the one or more reinforcing structures around at least a portion of the substrate prior to the thermally spraying step.

4. The method of claim 1, further comprising bonding the thermal spray layer with the one or more reinforcing structures.

5. The method of claim 1, further comprising depositing the metallic material onto the substrate such that the material solidifies and forms into a layer of material on the substrate and around the one or more reinforcing structures.

6. The method of claim 1, further comprising forming a coating on the external surface that comprises the metallic material and the one or more reinforcing structures.

7. The method of claim 1, wherein the one or more reinforcing structures comprises a different material than the thermally sprayed material.

8. The method of claim 1, wherein the thermal spray technique comprises twin wire arc spray.

9. The method of claim 1, further comprising:

thermally spraying a second layer of metallic material onto the first layer of metallic material; and embedding one or more reinforcing structures into the second layer of thermal spray.

10. A method for applying a coating to a substrate, comprising providing a substrate having an external surface;

coupling one or more reinforcing structures to the external surface, wherein the one or more reinforcing structures comprises mesh;

thermally spraying a layer of metallic material onto the one or more reinforcing structures; and embedding the one or more reinforcing structures into the thermal spray layer, wherein the coating comprises a corrosion resistant layer.

11. The method of claim 10, wherein the one or more reinforcing structures comprises metallic or non-metallic material, wherein the coupling step comprises attaching the mesh to the external surface at the same time or prior to the thermally spraying step.

12. The method of claim 10, wherein the coupling step comprises attaching the one or more reinforcing structures to the external surface of the substrate using micro-welding.

13. The method of claim 10, further comprising depositing the metallic material onto the substrate such that the material solidifies and forms into a layer of material on the substrate and around the one or more reinforcing structures.

14. The method of claim 1, wherein the one or more reinforcing structures is non-metallic.

15. The method of claim 1, wherein the one or more reinforcing structures is metallic.

16. The method of claim 10, wherein the coating comprises greater wear resistance than a coating without the one or more reinforcing structures.

17. The method of claim 1, wherein the one or more reinforcing structures comprises a first material, and the layer of thermally sprayed material comprises a second material.

18. The method of claim 10, wherein the coating comprises a plurality of different thermally sprayed layers, wherein the coating comprises a first layer with a first composition and a second layer with a second composition.

19. The method of claim 10, wherein the coating comprises a thickness of at least 0.10 inches on the substrate.

20. The method of claim 10, wherein the coating comprises a thickness of less than 0.10 inches on the substrate.

21. The method of claim 1, further comprising wrapping the one or more reinforcing structures around at least a portion of the substrate during the thermal spraying step.

22. The method of claim 1, further comprising rotating the substrate during the thermal spraying step.

23. The method of claim 1, further comprising coupling the one or more reinforcing structures to the external surface during the embedding step.

24. The method of claim 1, further comprising coupling the one or more reinforcing structures to the external surface by coupling the one or more reinforcing structures with the sprayed layer of metallic material.

25. The method of claim 1, wherein the spraying step comprises thermally spraying both the substrate and the one or more reinforcing structures.

26. The method of claim 1, wherein the spraying step comprises thermally spraying both the substrate and the one or more reinforcing structures at substantially the same time.

27. The method of claim 1, wherein the coupling step occurs while wrapping the one or more reinforcing structures around at least a portion of the substrate and while rotating the substrate.

28. The method of claim 10, wherein the spraying step comprises thermally spraying both the substrate and the one or more reinforcing structures after being coupled to the substrate.

29. The method of claim 10, further comprising thermally spraying a layer of metallic material onto the exterior surface of the substrate.

30. A method for forming a coating on a substrate, comprising:

providing a substrate having an external surface;

wrapping one or more reinforcing structures around at least a portion of the substrate, wherein the one or more reinforcing structures comprises mesh; and thermally spraying a layer of metallic material on the external surface; and coupling the one or more reinforcing structures to the substrate via the sprayed layer of metallic material.

31. The method of claim 30, wherein the spraying step comprises spraying the layer of metallic material on the one or more reinforcing structures.

32. The method of claim 30, further comprising embedding the one or more reinforcing structures into the thermal spray layer.

33. A method for forming a coating on a substrate, comprising:

providing a substrate having an external surface;

thermally spraying a layer of metallic material on the external surface;

embedding one or more reinforcing structures into the thermal spray layer, wherein the one or more reinforcing structures comprises mesh; and rotating the substrate during the thermal spraying step.

* * * * *